US007448723B2

(12) United States Patent
Morgan et al.

(10) Patent No.: US 7,448,723 B2
(45) Date of Patent: Nov. 11, 2008

(54) PRINTHEAD MAINTENANCE STATION WITH PAD CLEANING ACTION

(75) Inventors: John Douglas Peter Morgan, Balmain (AU); Kia Silverbrook, Balmain (AU); Christopher Hibbard, Balmain (AU); Bruce Gordon Holyoake, Balmain (AU)

(73) Assignee: Silverbrook Research Pty Ltd, Balmain, New South Wales (AU)

( * ) Notice: Subject to any disclaimer, the term of this patent is extended or adjusted under 35 U.S.C. 154(b) by 337 days.

(21) Appl. No.: 11/246,710

(22) Filed: Oct. 11, 2005

(65) Prior Publication Data

US 2007/0081004 A1 Apr. 12, 2007

(51) Int. Cl.
*B41J 2/165* (2006.01)

(52) U.S. Cl. ..... 347/29; 347/32

(58) Field of Classification Search ..... 347/29, 347/30, 32

See application file for complete search history.

(56) References Cited

U.S. PATENT DOCUMENTS 4,935,753 A * 6/1990 Lehmann et al. ..... 347/33
5,424,768 A * 6/1995 Dudek et al. ..... 347/29
5,467,114 A * 11/1995 Ebinuma et al. ..... 347/32
6,578,947 B1 * 6/2003 Suwabe et al. ..... 347/29

FOREIGN PATENT DOCUMENTS

EP 1142716 A1 10/2001
EP 0913263 B1 5/2003
JP 359055757 A * 3/1984 ..... 347/29
JP 2003341107 A 12/2003

* cited by examiner

*Primary Examiner*—Shih-wen Hsieh

(57) ABSTRACT

A printhead maintenance station for maintaining a printhead in an operable condition is provided. The maintenance station comprises an elastically deformable pad having a contact surface for sealing engagement with an ink ejection face of the printhead. The maintenance station also comprises an engagement mechanism for moving said pad between a first position in which the contact surface is sealingly engaged with the face, a second position in which the contact surface is disengaged from the face, and a third position in which the contact surface is engaged with a pad cleaner.

18 Claims, 16 Drawing Sheets

PRINTHEAD MAINTENANCE STATION WITH PAD CLEANING ACTION

FIELD OF THE INVENTION

This invention relates to a maintenance station for an inkjet printhead. It has been developed primarily for facilitating maintenance operations, such as sealing, cleaning or unblocking nozzles in an inkjet printhead.

CO-PENDING APPLICATIONS

The following applications have been filed by the Applicant simultaneously with the present application:

| | | | | | |
|---|---|---|---|---|---|
| 11/246676 | 11/246677 | 11/246678 | 11/246679 | 11/246680 | 11/246681 |
| 11/246714 | 11/246713 | 11/246689 | 11/246671 | 11/246670 | 11/246669 |
| 11/246704 | 11/246688 | 11/246716 | 11/246715 | 11/246707 | 11/246706 |
| 11/246705 | 11/246708 | 11/246693 | 11/246692 | 11/246696 | 11/246695 |
| 11/246694 | 11/246687 | 11/246718 | 11/246685 | 11/246686 | 11/246703 |
| 11/246691 | 11/246711 | 11/246690 | 11/246712 | 11/246717 | 11/246709 |
| 11/246700 | 11/246701 | 11/246702 | 11/246668 | 11/246697 | 11/246698 |
| 11/246699 | 11/246675 | 11/246674 | 11/246667 | 11/246684 | 11/246672 |
| 11/246673 | 11/246683 | 11/246682 | | | |

The disclosures of these co-pending applications are incorporated herein by reference. The above applications have been identified by their filing docket number, which will be substituted with the corresponding application number, once assigned.

CROSS REFERENCES TO RELATED APPLICATIONS

Various methods, systems and apparatus relating to the present invention are disclosed in the following US Patents/Patent Applications filed by the applicant or assignee of the present invention:

| | | | | | |
|---|---|---|---|---|---|
| 6750901 | 6476863 | 6788336 | 7249108 | 6566858 | 6331946 |
| 6246970 | 6442525 | 09/517384 | 09/505951 | 6374354 | 7246098 |
| 6816968 | 6757832 | 6334190 | 6745331 | 7249109 | 10/203559 |
| 7197642 | 7093139 | 10/636263 | 10/636283 | 10/866608 | 7210038 |
| 10/902883 | 10/940653 | 10/942858 | 11/003786 | 7258417 | 7293853 |
| 11/003334 | 7270395 | 11/003404 | 11/003419 | 11/003700 | 7255419 |
| 7284819 | 7229148 | 7258416 | 7273263 | 7270393 | 6984017 |
| 11/003699 | 11/071473 | 11/003463 | 11/003701 | 11/003683 | 11/003614 |
| 7284820 | 11/003684 | 7246875 | 11/003617 | 6623101 | 6406129 |
| 6505916 | 6457809 | 6550895 | 6457812 | 7152962 | 6428133 |
| 7204941 | 7282164 | 10/815628 | 7278727 | 10/913373 | 10/913374 |
| 10/913372 | 7138391 | 7153956 | 10/913380 | 10/913379 | 10/913376 |
| 7122076 | 7148345 | 11/172816 | 11/172815 | 11/172814 | 10/407212 |
| 7252366 | 10/683064 | 10/683041 | 6746105 | 7156508 | 7159972 |
| 7083271 | 7165834 | 7080894 | 7201469 | 7090336 | 7156489 |
| 10/760233 | 10/760246 | 7083257 | 7258422 | 7255423 | 7219980 |
| 10/760253 | 10/760255 | 10/760209 | 7118192 | 10/760194 | 10/760238 |
| 7077505 | 7198354 | 7077504 | 10/760189 | 7198355 | 10/760232 |
| 10/760231 | 7152959 | 7213906 | 7178901 | 7222938 | 7108353 |
| 7104629 | 7246886 | 7128400 | 7108355 | 6991322 | 7287836 |
| 7118197 | 10/728784 | 10/728783 | 7077493 | 6962402 | 10/728803 |
| 7147308 | 10/728779 | 7118198 | 7168790 | 7172270 | 7229155 |
| 6830318 | 7195342 | 7175261 | 10/773183 | 7108356 | 7118202 |
| 10/773186 | 7134744 | 10/773185 | 7134743 | 7182439 | 7210768 |
| 10/773187 | 7134745 | 7156484 | 7118201 | 7111926 | 10/773184 |
| 7018021 | 11/060751 | 11/060805 | 11/188017 | 11/097308 | 11/097309 |
| 7246876 | 11/097299 | 11/097310 | 11/097213 | 11/210687 | 11/097212 |
| 7147306 | 09/575197 | 7079712 | 6825945 | 09/575165 | 6813039 |
| 6987506 | 7038797 | 6980318 | 6816274 | 7102772 | 09/575186 |
| 6681045 | 6728000 | 7173722 | 7088459 | 09/575181 | 7068382 |

-continued

| | | | | | |
|---|---|---|---|---|---|
| 7062651 | 6789194 | 6789191 | 6644642 | 6502614 | 6622999 |
| 6669385 | 6549935 | 6987573 | 6727996 | 6591884 | 6439706 |
| 6760119 | 7295332 | 6290349 | 6428155 | 6785016 | 6870966 |
| 6822639 | 6737591 | 7055739 | 7233320 | 6830196 | 6832717 |
| 6957768 | 09/575172 | 7170499 | 7106888 | 7123239 | 10/727181 |
| 10/727162 | 10/727163 | 10/727245 | 7121639 | 7165824 | 7152942 |
| 10/727157 | 7181572 | 7096137 | 10/727257 | 7278034 | 7188282 |
| 10/727159 | 10/727180 | 10/727179 | 10/727192 | 10/727274 | 10/727164 |
| 10/727161 | 10/727198 | 10/727158 | 10/754536 | 10/754938 | 10/727227 |
| 10/727160 | 10/934720 | 7171323 | 10/296522 | 6795215 | 7070098 |
| 7154638 | 6805419 | 6859289 | 6977751 | 6398332 | 6394573 |
| 6622923 | 6747760 | 6921144 | 10/884881 | 7092112 | 7192106 |
| 11/039866 | 7173739 | 6986560 | 7008033 | 11/148237 | 7195328 |
| 7182422 | 10/854521 | 10/854522 | 10/854488 | 7281330 | 10/854503 |
| 10/854504 | 10/854509 | 7188928 | 7093989 | 10/854497 | 10/854495 |
| 10/854498 | 10/854511 | 10/854525 | 10/854525 | 10/854526 | 10/854516 |
| 7252353 | 10/854515 | 7267417 | 10/854505 | 10/854493 | 7275805 |
| 10/854489 | 10/854490 | 7281777 | 7290852 | 10/854528 | 10/854523 |
| 10/854527 | 10/854524 | 10/854520 | 10/854514 | 10/854519 | 10/854513 |
| 10/854499 | 10/854501 | 7266661 | 7243193 | 10/854518 | 10/854517 |
| 10/934628 | 7163345 | 10/760254 | 10/760254 | 10/760202 | 7201468 |
| 10/760198 | 10/760249 | 7234802 | 10/760196 | 7287846 | 7156511 |
| 10/760264 | 7258432 | 7097291 | 10/760222 | 10/760248 | 7083273 |
| 10/760192 | 10/760203 | 10/760204 | 10/760205 | 10/760206 | 10/760267 |
| 10/760270 | 7198352 | 10/760271 | 10/760275 | 7201470 | 7121655 |
| 7293861 | 7232208 | 10/760186 | 10/760261 | 7083272 | 11/014764 |
| 11/014763 | 11/014748 | 11/014747 | 11/014761 | 11/014760 | 11/014757 |
| 11/014714 | 7249822 | 11/014762 | 11/014724 | 11/014723 | 11/014756 |
| 11/014736 | 11/014759 | 11/014758 | 11/014725 | 11/014739 | 11/014738 |
| 11/014737 | 11/014726 | 11/014745 | 11/014712 | 7270405 | 11/014751 |
| 11/014735 | 11/014734 | 11/014719 | 11/014750 | 11/014749 | 7249833 |
| 11/014769 | 11/014729 | 11/014743 | 11/014733 | 11/014754 | 11/014755 |
| 11/014765 | 11/014766 | 11/014740 | 7284816 | 7284845 | 7255430 |
| 11/014744 | 11/014741 | 11/014768 | 11/014767 | 11/014718 | 11/014717 |
| 11/014716 | 11/014732 | 11/014742 | 11/097268 | 11/097185 | 11/097184 |

The disclosures of these applications and patents are incorporated herein by reference.

BACKGROUND OF THE INVENTION

Inkjet printers are commonplace in homes and offices. More recently, inkjet printers have been proposed for use in portable devices, such as digital cameras, mobile phones etc. Furthermore, with the advent of MEMS technology, whereby inexpensive photolithographic techniques from the semiconductor industry are used to manufacture microelectomechanical systems, the possibility of disposable inkjet printers is becoming a commercial reality. The present Applicant has developed many different types of MEMS inkjet printheads, some of which are described in the patents and patent applications listed in the above cross reference list.

The contents of these patents and patent applications are incorporated herein by cross-reference in their entirety.

Although the cost and power requirements of inkjet printheads is being reduced through the use of MEMS technology and improved inkjet nozzle designs, it is also necessary to reduce the cost and power requirements of other printer components, in order to incorporate inkjet printers into portable devices or to provide disposable inkjet printers.

A crucial aspect of inkjet printing is maintaining the printhead in an operational printing condition throughout its lifetime. A number of factors may cause an inkjet printhead to become non-operational and it is important for any inkjet printer to include a strategy for preventing printhead failure and/or restoring the printhead to an operational printing condition in the event of failure. Printhead failure may be caused by, for example, printhead face flooding, dried-up nozzles (due to evaporation of water from the nozzles—a phenomenon known in the art as decap), or particulates fouling nozzles.

In some cases, printhead failure may be remedied by simply firing nozzles periodically using a 'keep wet cycle'. This strategy does not require any external mechanical maintenance of the printhead and may be appropriate when a nozzle has not been fired for a relatively short period of time (e.g. less than 60 seconds). A 'keep wet cycle' can be used to address decap, and the consequent formation of viscous plugs in nozzles, during active printing.

However, a 'keep wet cycle' cannot be used when the printer is left idle over long periods of time, for example, when it is in between print jobs, switched off or in transit. Furthermore, a 'keep wet cycle' is not appropriate for clearing severely blocked nozzles and does not address the problem of printhead face flooding. Accordingly, inkjet printers typically include a printhead maintenance station, which is designed to prevent printhead failure and/or remediate printheads to an operational condition.

One measure that has been used for preventing printhead failure is sealing the printhead, thereby preventing evaporation of water and the drying up of nozzles. Commercial inkjet printers are typically supplied with a sealing tape across the printhead, which the user removes when the printer is installed for use. The sealing tape protects the primed printhead from particulates and prevents the nozzles from drying up during transit. Sealing tape also controls flooding of ink over the printhead face.

Aside from one-time use sealing tape on new printers, sealing has also been used as a strategy for maintaining printheads in an operational condition during printing. In some commercial printers, a gasket-type sealing ring and cap engages around a perimeter of the printhead when the printer is idle. With the printhead capped in this way, evaporation of water from the nozzles is minimized, and a relatively humid atmosphere can be maintained above the nozzles, thereby minimizing the extent to which nozzles dry up.

Furthermore, gasket-type sealing rings have been combined with suction cleaning in prior art maintenance stations. A vacuum may be connected to the sealing cap and used to suck ink from the nozzles. The sealing cap minimizes nozzle drying and entrance of particulates from the atmosphere, while the suction ensures any blocked nozzles are cleared prior to printing. Hence, this type of maintenance station employs both preventative and remedial measures.

Another remedial strategy used in prior art printhead maintenance stations is a rubber squeegee. The squeegee does not act as seal; rather, it is wiped across the printhead and removes any flooded ink. Squeegee cleaning may be used immediately prior to printing, after the vacuum flush described above.

The printhead maintenance strategies described above have several shortcomings, especially in the present age of inkjet printing. Modern inkjet printers are required to have smaller drop volumes, and hence smaller nozzle openings, for high resolution photographic printing. It is also desirable to use stationary pagewidth printheads for high-speed printing, as opposed to scanning printheads. It is also desirable to reduce the overall cost of inkjet printers and incorporate them into low-powered portable devices, such as digital cameras and mobile phones.

Current printhead maintenance strategies are unable to provide inkjet printers, which meet these demands. With smaller nozzle openings (of the order of 5-20 microns), nozzle blocking due to decap becomes a serious problem. At present, the only reliable way of dealing with blocked nozzles is to use a suction pad. However, suction devices are bulky, expensive and consume large amounts of power, making them unsuitable for many inkjet applications. Furthermore, suction pads are wasteful of ink and can consume up to 0.25 ml of ink with each remediation.

Additionally, none of the prior art maintenance stations are able to provide a printhead ready for printing after a single maintenance operation. Typically, it is necessary to employ separate preventative (e.g. sealing) and remedial (e.g. suction and squeegee-cleaning) measures in order to provide a fully operational printhead. However, operations such as squeegee-cleaning are not suitable for all types of printhead, because it exerts shear stress across the printhead and can damage sensitive nozzle structures.

Therefore, it would be desirable to provide an inkjet printhead maintenance station, which combines both preventative and remedial measures. It would further be desirable to provide an inkjet printhead maintenance station, which can be fabricated at low cost and is therefore suitable for fabrication of a disposable printer. It would be further desirable to provide an inkjet printhead maintenance station, which does not significantly impact on the overall size of the printer and is therefore suitable for incorporation into handheld electronic devices. It would be further desirable to provide an inkjet printhead maintenance station, which does not impact on the overall power consumption of the printer and is therefore suitable for incorporation into battery-powered electronic devices. It would be further desirable to provide an inkjet printhead maintenance station, which does not waste large quantities of ink with each remedial operation. It would further be desirable to provide an inkjet printhead maintenance station, which cleans ink from a flooded printhead without exerting high shear stresses across the printhead.

SUMMARY OF THE INVENTION

In a first aspect, there is provided a printhead maintenance station for maintaining a printhead in an operable condition, said maintenance station comprising:

an elastically deformable pad having a contact surface for sealing engagement with an ink ejection face of said printhead; and an engagement mechanism for moving said pad between a first position in which the contact surface is sealingly engaged with said face, and a second position in which said contact surface is disengaged from said face, wherein said maintenance station is configured such that said contact surface is progressively contacted with said face during sealing engagement and peeled away from said face during disengagement.

In a second aspect, there is provided a printhead assembly for maintaining a printhead in an operable condition, said assembly comprising:

a printhead having an ink ejection face; and a printhead maintenance station comprising:

an elastically deformable pad having a contact surface for sealing engagement with said face; and an engagement mechanism for moving said pad between a first position in which said contact surface is sealingly engaged with said face and a second position in which said contact surface is disengaged from said face, wherein said printhead assembly is configured such that said contact surface is progressively contacted with said face during sealing engagement and peeled away from said face during disengagement.

In a third aspect, there is provided a method of maintaining a printhead in an operable condition, said method comprising the steps of:

providing an elastically deformable pad having a contact surface for sealing engagement with an ink ejection face of said printhead; and moving said pad between a first position in which said contact surface is sealingly engaged with said face and a second position in which said contact surface is disengaged from said face, wherein said movement causes said contact surface to be progressively contacted with said face during sealing engagement and peeled away from said face during disengagement.

In a fourth aspect, there is provided a method of unblocking nozzles in a printhead, said method comprising the steps of:

providing an elastically deformable pad having a contact surface for sealing engagement with an ink ejection face of said printhead; and moving said pad from a first position in which said contact surface is sealingly engaged with said face to a second position in which said contact surface is disengaged from said face, wherein said movement causes said contact surface to be peeled away from said face during disengagement.

In a fifth aspect, there is provided a method of removing ink flooded across an ink ejection face of a printhead, said method comprising the steps of:

providing an elastically deformable pad having a contact surface for sealing engagement with an ink ejection face of said printhead; and moving said pad from a first position in which said contact surface is sealingly engaged with said face to a second position in which said contact surface is disengaged from said face, wherein said movement causes said contact surface to be peeled away from said face during disengagement.

In a sixth aspect, there is provided a method of sealing nozzles in an ink ejection face of a printhead, said method comprising the steps of:

providing an elastically deformable pad having a contact surface for sealing engagement with an ink ejection face of said printhead; and moving said pad from a second position in which said contact surface is disengaged from said face to a first position in which said contact surface is sealingly engaged with said face, wherein said movement causes said contact surface to be progressively contacted with said face during sealing engagement.

In a seventh aspect, there is provided a method of maintaining a printhead in an operable condition, said method comprising the steps of:

providing an elastically deformable pad having a contact surface for sealing engagement with an ink ejection face of said printhead; and moving said pad between a first position in which said contact surface is sealingly engaged with said face and a second position in which said contact surface is disengaged from said face, wherein said movement is such that ink wets from said printhead onto said contact surface during disengagement, but remain substantially in or on said printhead during engagement.

In an eighth aspect, there is provided a printhead maintenance station for maintaining a printhead in an operable condition, said maintenance station comprising:

an elastically deformable pad having a contact surface for sealing engagement with an ink ejection face of said printhead, said contact surface being sloped with respect to said face; and an engagement mechanism for moving said pad between a first position in which the contact surface is sealingly engaged with said face, and a second position in which said contact surface is disengaged from said face, wherein said engagement mechanism moves said pad substantially perpendicularly with respect to said face.

In a ninth aspect, there is provided a printhead maintenance station for maintaining a printhead in an operable condition, said maintenance station comprising:

an elastically deformable cylinder having a contact surface for sealing engagement with an ink ejection face of said printhead; and an engagement mechanism for moving said cylinder between a first position in which said contact surface is sealingly engaged with said face, and a second position in which said contact surface is disengaged from said face, wherein said engagement mechanism moves said cylinder substantially perpendicularly with respect to said face.

In a tenth aspect, there is provided a printhead maintenance station for maintaining a printhead in an operable condition, said maintenance station comprising:

an elastically deformable roller having a contact surface for contacting an ink ejection face of said printhead; and a mechanism for rolling said roller across said face.

In an eleventh aspect, there is provided a method of maintaining a printhead in an operable condition, said method comprising the steps of:

providing an elastically deformable roller having a contact surface for contacting an ink ejection face of said printhead; and rolling said roller across said face.

In a twelfth aspect, there is provided a printhead maintenance station for maintaining a printhead in an operable condition, said maintenance station comprising:

an elastically deformable pad having a contact surface for sealing engagement with an ink ejection face of said printhead; and an engagement mechanism for reciprocally moving said pad between a first position in which said contact surface is sealingly engaged with said face, and a second position in which said contact surface is disengaged from said face, wherein said engagement mechanism is configured to move said pad rotatably with respect to said printhead such that, during engagement, a first part of said surface is contacted with said face prior to a second part of said surface, and during disengagement said second part is disengaged from said face prior said first part.

In a thirteenth aspect, there is provided a printhead assembly comprising:

a printhead having an ink ejection face; and a wicking element positioned for receiving ink from an edge portion of said printhead and/or an edge portion of a pad being disengaged from said face.

In a fourteenth aspect, there is provided a printhead maintenance station for maintaining a printhead in an operable condition, said maintenance station comprising:

an elastically deformable pad having a contact surface for sealing engagement with an ink ejection face of said printhead; and an engagement mechanism for moving said pad between a first position in which said contact surface is sealingly engaged with said face, a second position in which said contact surface is disengaged from said face, and a third position in which said contact surface is engaged with a pad cleaner.

In a fifteenth aspect, there is provided a method of maintaining a printhead in an operable condition, said method comprising the steps of:

providing an elastically deformable pad having a contact surface for sealing engagement with an ink ejection face of said printhead; and moving said pad between a first position in which said contact surface is sealingly engaged with said face, a second position in which said contact surface is disengaged from said face, and a third position in which said contact surface is engaged with a pad cleaner.

In a sixteenth aspect, there is provided a printhead assembly comprising:

a printhead mounted on a support, said printhead having an ink ejection face; and a film cooperating with said support to define a wicking channel, wherein said wicking channel is positioned for receiving ink from an edge portion of said printhead and/or an edge portion of a pad being disengaged from said face.

In a seventeenth aspect, there is provided a method of removing ink from an ink ejection face of a printhead, said method comprising the steps of:

(a) moving said ink towards an edge portion of said printhead; and (b) wicking said ink away from said edge portion.

For the avoidance of doubt, the term "progressively contacted" is used to mean a type of engagement, which is opposite to "peeling away". In other words, different portions of the contact surface progressively come into contact with the ink ejection face at different times during engagement. Likewise, different portions of the contact surface are progressively peeled away from the ink ejection face at different times during disengagement. The specification and drawings below describe in detail this type of engagement and disengagement, and various ways of achieving such engagement and disengagement.

The printhead maintenance station advantageously combines both preventative and remedial measures for maintaining an inkjet printhead in an operable condition. In terms of preventative measures, the contact surface seals the ink ejection face, thereby minimizing evaporation of water from the nozzles and minimizing the effects of ink drying up inside the nozzles. Sealing engagement of the contact surface with the ink ejection face also protects the printhead from particulates in the atmosphere, which can damage or block nozzles. Typically, the pad is held in its first position when the printhead is left idle over relatively long periods. However, the pad may be moved into sealing engagement at any time when the printhead is not printing.

In terms of remedial measures, the contact surface cleans ink from the ink ejection face due to the unique interaction between the contact surface and the printhead. From a detailed analysis of advancing and receding contact angles, the present inventors have found that peeling disengagement of the contact surface from the ink ejection face has the effect of moving ink along the contact surface (or the ink ejection face) towards an edge portion. Once deposited at an edge portion, the ink may be readily removed. A detailed explanation of the principle of advancing and receding contact angles, and how these relate to the present invention is given below.

In addition to cleaning flooded ink from the ink ejection face, the peeling disengagement action of the contact surface from the printhead also has the effect of unblocking nozzles. Peeling disengagement generates a negative pressure above nozzles in the printhead and, hence, draws out viscous ink material or particulate contaminants blocking the nozzles. Accordingly, the peeling disengagement has the combined effects of clearing blocked nozzles and removing ink to an edge portion of the contact surface or printhead.

A further advantage of the printhead maintenance station is that it has a simple design, which is compact, can be manufactured at low cost and consumes very little power. The suction devices of the prior art require external pumps, which add significantly to the cost and power consumption of prior art printers. Moreover, the requirement of an external vacuum pump adds significantly to the bulk of prior art printers. By obviating the need for a vacuum pump to effectively unblock printhead nozzles, the present invention allows inkjet printers to be installed into a wider range of devices and also opens up the potential for a commercially-viable disposable inkjet printer.

A further advantage of the printhead maintenance station is that nozzles can be unblocked without wasting large quantities of ink. Whereas prior art suction devices are wasteful of ink, adding to the overall cost of printer operation, the present invention withdraws only a minimum quantity of ink from nozzles during remediation. Moreover, by depositing the ink onto an edge portion of the pad (and/or the printhead), the means for removing this ink is greatly simplified.

A further advantage of the printhead maintenance station is that the cleaning action exerts minimal shear stress across the ink ejection face. Accordingly, sensitive nozzle structures are less likely to be damaged during maintenance when compared to, for example, wiping or squeegee cleaning of printheads.

Optionally, the pad is substantially coextensive with the printhead. A pad configured in this way ensures maintenance of the entire printhead, whilst simplifying the design of the maintenance station as far as possible. As described below a portion of the pad may extend beyond one end of the printhead, although this type of arrangement is still understood to be within the definition of the term 'substantially coextensive'.

Optionally, the contact surface is substantially uniform, so that ink can flow freely across its surface. Optionally, the contact surface should have a minimal number of pits or indentations, to avoid trapping ink in micro-pockets and consequently reducing the efficacy of the cleaning action.

The pad is elastically deformable and, preferably, has minimal or no creep. Elastic deformability provides sealing engagement of the pad with the printhead. Moreover, it ensures the pad can be used repeatedly without loss of either sealing or cleaning performance. Suitable materials for forming the pad include thermosetting or thermoplastic elastomers. For example, the pad may be comprised of silicone, polyurethane, Neoprene®, Santoprene® or Kraton®. Optionally, the pad is comprised of a silicone rubber.

Optionally a peel zone between the contact surface and the ink ejection face advances and retreats transversely across the ink ejection face during engagement and disengagement. In this embodiment, ink retreats with the peel zone in a longitudinal line towards a longitudinal edge portion of the contact surface or printhead as the pad is peeled away. This has the advantage that the ink travels a minimum distance across the ink ejection face and maximizes the cleaning efficiency of the maintenance station.

Optionally, the engagement mechanism moves the pad substantially perpendicularly with respect to the ink ejection face. This arrangement has the advantage of simplifying the motion of the pad and, moreover, the means for achieving this. For example, a simple solenoid or motor/cam arrangement, consuming very little power, may be used to provide reciprocal linear movement of the pad.

Optionally, the pad is received in a housing with the pad being slidably movable relative to the housing. Typically, the pad extends through a slit in the housing in the first position and the pad is retracted into the housing in the second position. Optionally, the pad is mounted on a support arm, the arm having lugs at each end for engagement with the engagement mechanism. The lugs extend through complementary slots in side walls of the housing, thereby allowing sliding movement of the support arm and the pad.

With the pad being moved perpendicularly with respect to the ink ejection face, the unique engagement action of the contact surface is usually determined by the profile of the contact surface itself. Optionally, the pad is configured so that the contact surface is sloped with respect to the ink ejection face. Accordingly, during perpendicular engagement of the pad with the ink ejection face, a first end of the contact surface is contacted before a second end of the contact surface. Sloping of the contact surface may be in the form of a linear gradient (i.e. the contact surface is flat). For example, the contact surface may be angled at 5-30°, 8-20° or 10-15° with respect to the ink ejection face. Alternatively, sloping of the contact surface may be in the form of a curved or rounded gradient. In either case, progressive contact of the surface with the ink ejection face is ensured during engagement. Likewise, a peeling motion is ensured during disengagement.

Optionally, the pad is wedge-shaped with an angled surface of the wedge being the contact surface presented to the ink ejection face. A wedge-shaped pad is advantageous, since its manufacture is relatively facile using conventional molding, machining or laser-cutting techniques.

Optionally, a peel zone between the contact surface and the ink ejection face advances and retreats longitudinally along the printhead during engagement and disengagement. In this embodiment, ink retreats with the peel zone in a tranverse line towards a transverse edge portion of the contact surface or ink ejection face as the pad is peeled away. An advantage of this arrangement is that excess ink is concentrated into a smaller area by the cleaning action, making its removal more facile.

Optionally, the engagement mechanism is configured to move the pad rotatably with respect to the ink ejection face. An advantage of this arrangement is that the pad need not be specially shaped to provide the requisite engagement and disengagement action. A simple cuboid block of silicone rubber may be employed as the pad, with the rotational movement ensuring that a first end of the contact surface is contacted with the ink ejection face before a second end of the contact surface.

As mentioned above, engagement of the pad may be provided so as to engage the contact surface progressively transversely across the printhead, or progressively longitudinally along the ink ejection face. Optionally, the pad is mounted on an arm, which is rotatably mounted about a pivot. Optionally, the pivot axis is substantially parallel with a transverse axis of the printhead such that the contact surfaces engages progressively longitudinally along the ink ejection face.

The maintenance station is typically configured so that peeling disengagement of the contact surface from the ink ejection face draws ink from the printhead towards an edge portion of the contact surface, the ink ejection face, or both. This cleaning action may be used to clear blocked nozzles and remove ink flooded on the surface of the ink ejection face.

The speed of engagement and disengagement, together with the contact time, may be varied in order to optimize the cleaning action. Optimal cleaning will also depend on other factors, such as the size of printhead, the elasticity of the pad, the shape of the pad, the motion of the engagement mechanism etc. The skilled person will readily be able to optimize cleaning of the printhead for any given system by varying one or more of these parameters.

The pad may be moved according to a predetermined algorithm, depending on the expected severity of nozzle blockage. For example, different maintenance actions may be suitable for different printer conditions (e.g. first use, paperjam, recovery, user intervention etc.). Some situations may require five reciprocal movements of the pad, whereas other situations may require only one engage/disengage sequence. Suitable algorithms may be programmed into a control system controlling operation of the printhead maintenance station.

Optionally, the maintenance station further comprises an ink removal system for removing ink deposited on an edge portion of the contact surface or ink ejection face. The ink removal system advantageously avoids build up of ink on the pad or on the printhead, and channels any surplus ink away from the printhead.

The ink removal system may comprise any substrate or mechanism that can effectively remove ink from the edge portion(s). For example, the pad may be moved and contacted with an absorbent material after it has disengaged from the printhead.

Optionally, the ink removal system comprises a wicking element positioned adjacent an edge of the printhead. Ink which has been deposited towards the edge of the printhead and the pad is absorbed into the wicking element, which may simply be an absorbent material, and removed by wicking through the material. This arrangement has the advantage of simplicity and obviates the need for additional moving parts or a vacuum system in the maintenance station.

Optionally, the wicking element is positioned away from wirebonds on the printhead. The wirebonds are usually positioned along one longitudinal edge portion of the printhead, and the wicking element is optionally positioned adjacent an opposite longitudinal edge portion. Optionally, the wicking element extends into a cavity defined by a print media guide and a support to which the guide is mounted. This advantageously avoids ink from flooding and becoming trapped inside this cavity.

Optionally, the ink removal system further comprises an ink collector for receiving ink, which has wicked through the wicking element. By channeling surplus ink into a dedicated collector, the ink may be continuously taken away from the printhead region and cannot re-contaminate the printhead.

Optionally, the ink removal system comprises a film attached to the printhead support, wherein the film defines a wicking channel. The film is positioned such that the channel receives ink from an edge portion of the face and/or an edge portion of the pad being disengaged from the face. Optionally, the wicking channel is tapered to provide a capillary action. Optionally, a channel inlet is positioned adjacent proximal to the printhead and a channel outlet is positioned distal from the printhead, the channel being tapered towards the channel outlet. The channel inlet is typically defined by a proximal edge portion of the film, while the channel outlet is defined by a distal edge portion of the film.

Optionally, the film is anchored to the support along its distal edge portion via a plurality of anchor points. Typically, the anchor points are spaced apart to allow ink to exit the channel outlet. Alternatively, the distal edge portion of the film is attached to the print media guide and the distal edge portion be sandwiched between the print media guide and the support. Such an arrangement has manufacturing advantages in an automated assembly process when compared to bonding the film directly to the support.

Optionally, the film is substantially coextensive with the printhead and positioned adjacent a longitudinal edge thereof. Optionally, a plurality of vents are defined in the film. The vents are positioned for receiving ink from an outer surface of the film. Typically, the vents are positioned towards the channel inlet. The vents may take the form of elongate slots extending parallel with a longitudinal edge of the film.

Typically, the film is resiliently displaceable and is usually comprised of a polymer. Examples of suitable polymer films include polyester, polyethylene, polypropylene, polyacrylate films etc.

Optionally, an edge portion of the pad extends beyond an edge of the printhead, such that at least part of the pad abuts the film when the pad is engaged with the face. Accordingly, the channel may be resiliently defined as the pad disengages from the face.

As an alternative, or in addition to the wicking element or wicking channel adjacent the printhead, the pad is optionally moveable to a third position in which it is engaged with a pad cleaner. Typically, the pad is rotated into engagement with the pad cleaner after disengagement from the ink ejection face of the printhead. The pad cleaner may be, for example, a rubber squeegee or an absorbent pad and typically forms part of the printhead maintenance station.

The invention has been developed primarily for use with a pagewidth inkjet printhead. Optionally, the printhead comprises a plurality of nozzles, with each nozzle having a diameter of less than 20 microns or less than 15 microns.

However, the invention is equally applicable to any type of printhead where sealing and/or remedial measures are required to maintain the printhead in an operable condition. For example, the invention may be used in connection with standard scanning inkjet printheads in order to simplify conventional maintenance stations.

In a first aspect the present invention provides a printhead maintenance station for maintaining a printhead in an operable condition, said maintenance station comprising:

an elastically deformable pad having a contact surface for sealing engagement with an ink ejection face of said printhead; and an engagement mechanism for moving said pad between a first position in which said contact surface is sealingly engaged with said face, and a second position in which said contact surface is disengaged from said face, wherein said maintenance station is configured such that said contact surface is progressively contacted with said face during sealing engagement and peeled away from said face during disengagement.

Optionally, said pad is substantially coextensive with said printhead.

Optionally, said contact surface is substantially uniform.

Optionally, said pad is comprised of silicone, polyurethane, Neoprene®, Santoprene® or Kraton®.

Optionally, a peel zone between said contact surface and said ink ejection face advances and retreats transversely across said face during engagement and disengagement.

Optionally, said engagement mechanism moves said pad substantially perpendicularly with respect to said ink ejection face.

Optionally, said contact surface is sloped with respect to said ink ejection face such that, during engagement, a first part of said surface is contacted with said face prior to a second part of said surface.

Optionally, said pad is wedge-shaped.

Optionally, a peel zone between said contact surface and said ink ejection face advances and retreats longitudinally along said face during engagement and disengagement.

Optionally, said engagement mechanism is configured to move said pad rotatably with respect to said printhead such that, during engagement, a first part of said surface is contacted with said ink ejection face prior to a second part of said surface.

Optionally, said pad is fixed to an arm and said arm is rotatably mounted about a pivot, wherein said pivot is substantially parallel with a transverse axis of said printhead.

Optionally, said pad is biased towards said first position.

Optionally, said peeling disengagement draws ink from said printhead towards an edge portion of said contact surface and/or said face.

In a further aspect the maintenance station further comprising an ink removal system for removing ink from an edge portion of said contact surface and/or said face.

Optionally, said ink removal system comprises a wicking element or wicking channel positioned adjacent an edge of said printhead.

Optionally, said wicking element or wicking channel is positioned to receive ink from said edge portion of said contact surface when said contact surface is being disengaged from said face.

Optionally, said ink removal system further comprises an ink collector for receiving ink wicked through said wicking element or wicking channel.

Optionally, said printhead is an inkjet printhead.

Optionally, said printhead is a pagewidth printhead.

In a second aspect the present invention provides a printhead assembly for maintaining a printhead in an operable condition, said assembly comprising:

a printhead having an ink ejection face; and a printhead maintenance station comprising:

an elastically deformable pad having a contact surface for sealing engagement with said face; and an engagement mechanism for moving said pad between a first position in which said contact surface is sealingly engaged with said face and a second position in which said contact surface is disengaged from said face, wherein said printhead assembly is configured such that said contact surface is progressively contacted with said face during sealing engagement and peeled away from said face during disengagement.

Optionally, said pad is substantially coextensive with said printhead.

Optionally, said contact surface is substantially uniform.

Optionally, said pad is comprised of silicone, polyurethane, Neoprene®, Santoprene® or Kraton®.

Optionally, a peel zone between said contact surface and said ink ejection face advances and retreats transversely across said face during engagement and disengagement.

Optionally, said engagement mechanism moves said pad substantially perpendicularly with respect to said ink ejection face.

Optionally, said contact surface is sloped with respect to said ink ejection face such that, during engagement, a first part of said surface is contacted with said face prior to a second part of said surface.

Optionally, said pad is wedge-shaped.

Optionally, a peel zone between said contact surface and said ink ejection face advances and retreats longitudinally along said face during engagement and disengagement.

Optionally, said engagement mechanism is configured to move said pad rotatably with respect to said printhead such that, during engagement, a first part of said surface is contacted with said ink ejection face prior to a second part of said surface.

Optionally, said pad is fixed to an arm and said arm is rotatably mounted about a pivot, wherein said pivot is substantially parallel with a transverse axis of said printhead.

Optionally, said pad is biased towards said first position.

Optionally, said peeling disengagement draws ink from said printhead towards an edge portion of said contact surface and/or said face.

In a further aspect there is provided a printhead assembly, further comprising an ink removal system for removing ink from an edge portion of said contact surface and/or said face.

Optionally, said ink removal system comprises a wicking element or wicking channel positioned adjacent an edge of said printhead.

Optionally, said wicking element or wicking channel is positioned to receive ink from said edge portion of said contact surface when said contact surface is being disengaged from said face.

Optionally, said ink removal system further comprises an ink collector for receiving ink wicked through said wicking element or wicking channel.

Optionally, said printhead is an inkjet printhead.

Optionally, said printhead is a pagewidth printhead.

Optionally, said printhead comprises a plurality of ink ejection nozzles, each nozzle having a diameter of less than 20 microns.

In a third aspect the present invention provides a method of maintaining a printhead in an operable condition, said method comprising the steps of:

providing an elastically deformable pad having a contact surface for sealing engagement with an ink ejection face of said printhead; and moving said pad between a first position in which said contact surface is sealingly engaged with said face and a second position in which said contact surface is disengaged from said face, wherein said movement causes said contact surface to be progressively contacted with said face during sealing engagement and peeled away from said face during disengagement.

Optionally, said pad is substantially coextensive with said printhead.

Optionally, said contact surface is substantially uniform.

Optionally, said pad is comprised of silicone, polyurethane, Neoprene®, Santoprene® or Kraton®.

Optionally, a peel zone between said contact surface and said ink ejection face advances and retreats transversely across said face during engagement and disengagement.

Optionally, said pad is moved substantially perpendicularly with respect to said ink ejection face.

Optionally, said contact surface is sloped with respect to said ink ejection face such that, during engagement, a first part of said surface is contacted with said face prior to a second part of said surface.

Optionally, said pad is wedge-shaped.

Optionally, a peel zone between said contact surface and said ink ejection face advances and retreats longitudinally along said face during engagement and disengagement.

Optionally, said pad is moved rotatably with respect to said printhead such that, during engagement, a first part of said surface is contacted with said ink ejection face prior to a second part of said surface.

Optionally, said pad is fixed to an arm and said arm is rotatably moved about a pivot, wherein said pivot is substantially parallel with a transverse axis of said printhead.

Optionally, said pad is biased towards said first position.

Optionally, said peeling disengagement draws ink from said printhead towards an edge portion of said contact surface and/or said face.

Optionally, ink deposited on an edge portion of said contact surface and/or said face is removed.

Optionally, said ink is removed using a wicking element or wicking channel positioned adjacent an edge of said printhead.

Optionally, said wicking element or wicking channel receives ink from said edge portion of said contact surface when said contact surface is being disengaged from said face.

Optionally, said ink is wicked through said wicking element or wicking channel and received in an ink collector.

Optionally, said printhead is an inkjet printhead.

Optionally, said printhead is a pagewidth printhead.

In a fourth aspect the present invention provides a method of unblocking nozzles in a printhead, said method comprising the steps of:

providing an elastically deformable pad having a contact surface for sealing engagement with an ink ejection face of said printhead; and moving said pad from a first position in which said contact surface is sealingly engaged with said face to a second position in which said contact surface is disengaged from said face, wherein said movement causes said contact surface to be peeled away from said face during disengagement.

Optionally, said pad is substantially coextensive with said printhead.

Optionally, said contact surface is substantially uniform.

Optionally, said pad is comprised of silicone, polyurethane, Neoprene®, Santoprene® or Kraton®.

Optionally, a peel zone between said contact surface and said ink ejection face retreats transversely across said face during disengagement.

Optionally, said pad is moved substantially perpendicularly with respect to said ink ejection face.

Optionally, said contact surface is sloped with respect to said ink ejection face such that, during disengagement, a first part of said surface is separated from said face prior to a second part of said surface.

Optionally, said pad is wedge-shaped.

Optionally, a peel zone between said contact surface and said ink ejection face retreats longitudinally along said face during disengagement.

Optionally, said pad is moved rotatably with respect to said printhead such that, during disengagement, a first part of said surface is separated from said ink ejection face prior to a second part of said surface.

Optionally, said pad is fixed to an arm and said arm is rotatably moved about a pivot, wherein said pivot is substantially parallel with a transverse axis of said printhead.

Optionally, said pad is biased towards said first position.

Optionally, said peeling disengagement draws ink from said printhead towards an edge portion of said contact surface and/or said face.

Optionally, ink deposited on an edge portion of said contact surface and/or said face is removed.

Optionally, said ink is removed using a wicking element or wicking channel positioned adjacent an edge of said printhead.

Optionally, said wicking element or wicking channel receives ink from said edge portion of said contact surface when said contact surface is being disengaged from said face.

Optionally, said ink is wicked through said wicking element or wicking channel and received in an ink collector.

Optionally, said nozzles are blocked with viscous ink.

Optionally, said printhead is an inkjet printhead.

Optionally, said printhead is a pagewidth printhead.

In a fifth aspect the present invention provides a method of removing ink flooded across an ink ejection face of a printhead, said method comprising the steps of:

providing an elastically deformable pad having a contact surface for sealing engagement with an ink ejection face of said printhead; and moving said pad from a first position in which said contact surface is sealingly engaged with said face to a second position in which said contact surface is disengaged from said face, wherein said movement causes said contact surface to be peeled away from said face during disengagement.

Optionally, said pad is substantially coextensive with said printhead.

Optionally, said contact surface is substantially uniform.

Optionally, said pad is comprised of silicone, polyurethane, Neoprene®, Santoprene® or Kraton®.

Optionally, a peel zone between said contact surface and said ink ejection face retreats transversely across said face during disengagement.

Optionally, said pad is moved substantially perpendicularly with respect to said ink ejection face.

Optionally, said contact surface is sloped with respect to said ink ejection face such that, during disengagement, a first part of said surface is separated from said face prior to a second part of said surface.

Optionally, said pad is wedge-shaped.

Optionally, a peel zone between said contact surface and said ink ejection face retreats longitudinally along said face during disengagement.

Optionally, said pad is moved rotatably with respect to said printhead such that, during disengagement, a first part of said surface is separated from said ink ejection face prior to a second part of said surface.

Optionally, said pad is fixed to an arm and said arm is rotatably moved about a pivot, wherein said pivot is substantially parallel with a transverse axis of said printhead.

Optionally, said pad is biased towards said first position.

Optionally, said peeling disengagement draws ink from said printhead towards an edge portion of said contact surface and/or said face.

Optionally, ink deposited on an edge portion of said contact surface and/or said face is removed.

Optionally, said ink is removed using a wicking element or wicking channel positioned adjacent an edge of said printhead.

Optionally, said wicking element or wicking channel receives ink from said edge portion of said contact surface when said contact surface is being disengaged from said face.

Optionally, said ink is wicked through said wicking element or wicking channel and received in an ink collector.

Optionally, said printhead is an inkjet printhead.

Optionally, said printhead is a pagewidth printhead.

In a sixth aspect the present invention provides a method of sealing nozzles on an ink ejection face of a printhead, said method comprising the steps of:

providing an elastically deformable pad having a contact surface for sealing engagement with said ink ejection face; and moving said pad from a second position in which said contact surface is disengaged from said face to a first position in which said contact surface is sealingly engaged with said face, wherein said movement causes said contact surface to be progressively contacted with said face during sealing engagement.

Optionally, said pad is substantially coextensive with said printhead.

Optionally, said contact surface is substantially uniform.

Optionally, said pad is comprised of silicone, polyurethane, Neoprene®, Santoprene® or Kraton®.

Optionally, a peel zone between said contact surface and said ink ejection face advances transversely across said face during engagement.

Optionally, said pad is moved substantially perpendicularly with respect to said ink ejection face.

Optionally, said contact surface is sloped with respect to said ink ejection face such that, during engagement, a first part of said surface is contacted with said face prior to a second part of said surface.

Optionally, said pad is wedge-shaped.

Optionally, a peel zone between said contact surface and said ink ejection face advances longitudinally along said face during engagement.

Optionally, said pad is moved rotatably with respect to said printhead such that, during engagement, a first part of said surface is contacted with said ink ejection face prior to a second part of said surface.

Optionally, said pad is fixed to an arm and said arm is rotatably moved about a pivot, wherein said pivot is substantially parallel with a transverse axis of said printhead.

Optionally, said pad is biased towards said first position.

Optionally, ink from said printhead is not drawn onto said contact surface during said engagement.

Optionally, said printhead is an inkjet printhead.

Optionally, said printhead is a pagewidth printhead.

In a seventh aspect the present invention provides a method of maintaining a printhead in an operable condition, said method comprising the steps of:

providing an elastically deformable pad having a contact surface for sealing engagement with an ink ejection face of said printhead; and moving said pad between a first position in which said contact surface is sealingly engaged with said face and a second position in which said contact surface is disengaged from said face, wherein said movement is such that ink wets from said printhead onto said contact surface during disengagement, but remains substantially in or on said printhead during engagement.

Optionally, an advancing contact angle of said ink on said contact surface during engagement is greater than a receding contact angle of said ink on said contact surface during disengagement.

Optionally, said pad is substantially coextensive with said printhead.

Optionally, said contact surface is substantially uniform.

Optionally, said pad is comprised of silicone, polyurethane, Neoprene®, Santoprene® or Kraton®.

Optionally, a peel zone between said contact surface and said ink ejection face advances and retreats transversely across said face during engagement and disengagement.

Optionally, said pad is moved substantially perpendicularly with respect to said ink ejection face.

Optionally, said contact surface is sloped with respect to said ink ejection face such that, during engagement, a first part of said surface is contacted with said face prior to a second part of said surface.

Optionally, said pad is wedge-shaped.

Optionally, a peel zone between said contact surface and said ink ejection face advances and retreats longitudinally along said face during engagement and disengagement.

Optionally, said pad is moved rotatably with respect to said printhead such that, during engagement, a first part of said surface is contacted with said ink ejection face prior to a second part of said surface.

Optionally, said pad is fixed to an arm and said arm is rotatably moved about a pivot, wherein said pivot is substantially parallel with a transverse axis of said printhead.

Optionally, said pad is biased towards said first position.

Optionally, said disengagement draws ink towards an edge portion of said contact surface.

Optionally, ink deposited on an edge portion of said contact surface is removed.

Optionally, said ink is removed using a wicking element or wicking channel positioned adjacent an edge of said printhead.

Optionally, said wicking element or wicking channel receives ink from said edge portion of said contact surface when said contact surface is being disengaged from said face.

Optionally, said ink is wicked through said wicking element or wicking channel and received in an ink collector.

Optionally, said printhead is an inkjet printhead.

Optionally, said printhead is a pagewidth printhead.

In an eighth aspect the present invention provides a printhead maintenance station for maintaining a printhead in an operable condition, said maintenance station comprising:

an elastically deformable pad having a contact surface for sealing engagement with an ink ejection face of said printhead, said contact surface being sloped with respect to said face; and an engagement mechanism for moving said pad between a first position in which the contact surface is sealingly engaged with said face, and a second position in which said contact surface is disengaged from said face, wherein said engagement mechanism moves said pad substantially perpendicularly with respect to said face.

Optionally, said pad is substantially coextensive with said printhead.

Optionally, said contact surface is substantially uniform.

Optionally, said pad is comprised of silicone, polyurethane, Neoprene®, Santoprene® or Kraton®.

Optionally, said contact surface is flat.

Optionally, said pad is wedge-shaped.

Optionally, said contact surface is curved.

Optionally, a peel zone between said contact surface and said ink ejection face advances and retreats transversely across said face during engagement and disengagement.

Optionally, said pad is biased towards said first position.

Optionally, said pad is received in a housing and said pad is slidably movable relative to said housing.

Optionally, said pad extends through a slit in said housing in said first position and said pad is retracted into said housing in said second position.

Optionally, said pad is mounted on a support arm, said arm having a lug at each end for engagement with said engagement mechanism, wherein said lugs extend through complementary slots in side walls of said housing, thereby allowing sliding movement of said support arm.

Optionally, said peeling disengagement draws ink from said printhead towards a longitudinal edge portion of said contact surface and/or said face.

In a further aspect there is provided a maintenance station, further comprising an ink removal system for removing ink from an edge portion of said contact surface and/or said face.

Optionally, said ink removal system comprises a wicking element or wicking channel positioned adjacent an edge of said printhead.

Optionally, said wicking element or wicking channel is positioned to receive ink from said edge portion of said contact surface when said contact surface is being disengaged from said face.

Optionally, said ink removal system further comprises an ink collector for receiving ink wicked through said wicking element or wicking channel.

Optionally, said printhead is an inkjet printhead.

Optionally, said printhead is a pagewidth printhead.

In a ninth aspect the present invention provides a printhead maintenance station for maintaining a printhead in an operable condition, said maintenance station comprising:

an elastically deformable cylinder having a contact surface for sealing engagement with an ink ejection face of said printhead; and an engagement mechanism for moving said cylinder between a first position in which said contact surface is sealingly engaged with said face, and a second position in which said contact surface is disengaged from said face, wherein said engagement mechanism moves said cylinder substantially perpendicularly with respect to said face.

Optionally, said cylinder is substantially coextensive with said printhead.

Optionally, said contact surface is substantially uniform.

Optionally, said cylinder is comprised of silicone, polyurethane, Neoprene®, Santoprene® or Kraton®.

Optionally, said cylinder is offset from said printhead.

Optionally, a peel zone between said contact surface and said ink ejection face advances and retreats transversely across said face during engagement and disengagement.

Optionally, said cylinder is biased towards said first position.

Optionally, said peeling disengagement draws ink from said printhead towards a predetermined region on said cylinder and/or an edge portion of said face.

In a further aspect there is provided a maintenance station, further comprising an ink removal system for removing ink from a predetermined region of said contact surface and/or said face.

Optionally, said ink removal system comprises a wicking element or wicking channel positioned adjacent an edge of said printhead.

Optionally, said wicking element or wicking channel is positioned to receive ink from said predetermined region of said contact surface when said contact surface is being disengaged from said face.

Optionally, said ink removal system further comprises an ink collector for receiving ink wicked through said wicking element or wicking channel.

Optionally, said printhead is an inkjet printhead.

Optionally, said printhead is a pagewidth printhead.

In a tenth aspect the present invention provides a printhead maintenance station for maintaining a printhead in an operable condition, said maintenance station comprising:

an elastically deformable roller having a contact surface for contacting an ink ejection face of said printhead; and a mechanism for rolling said roller across said face.

Optionally, said roller is substantially coextensive with said printhead.

Optionally, said contact surface is substantially uniform.

Optionally, said roller is comprised of silicone, polyurethane, Neoprene®, Santoprene® or Kraton®.

Optionally, said roller rolls transversely across said printhead.

Optionally, a leading peel zone between said roller and said face is dry relative to a tailing peel zone between said roller and said face.

Optionally, said rolling action draws ink from said printhead towards a predetermined region on said roller and/or an edge portion of said face.

In a further aspect there is provided a maintenance station, further comprising an ink removal system for removing ink from said roller and/or said face.

Optionally, said ink removal system comprises a wicking element or wicking channel positioned adjacent an edge of said printhead.

Optionally, said wicking element or wicking channel is positioned to receive ink from said roller after it has roller across said face.

Optionally, said ink removal system further comprises an ink collector for receiving ink wicked through said wicking element or wicking channel.

Optionally, said printhead is an inkjet printhead.

Optionally, said printhead is a pagewidth printhead.

In an eleventh aspect the present invention provides a method of maintaining a printhead in an operable condition, said method comprising the steps of:

providing an elastically deformable roller having a contact surface for contacting an ink ejection face of said printhead; and rolling said roller across said face.

Optionally, said roller is substantially coextensive with said printhead.

Optionally, said contact surface is substantially uniform.

Optionally, said roller is comprised of silicone, polyurethane, Neoprene®, Santoprene® or Kraton®.

Optionally, said roller rolls transversely across said printhead.

Optionally, a contact angle hysteresis between a leading peel zone of said roller and a tailing peel zone of said roller is caused by said rolling action.

Optionally, a leading peel zone of said roller is dry relative to a tailing peel zone of said roller.

Optionally, said rolling action draws ink from said printhead towards a predetermined region on said roller and/or an edge portion of said face.

In a further aspect there is provided a method, further comprising an ink removal system for removing ink from said roller and/or said face.

Optionally, said ink removal system comprises a wicking element or wicking channel positioned for receiving ink from said roller and/or said face.

Optionally, said ink removal system further comprises an ink collector for receiving ink wicked through said wicking element or wicking channel.

Optionally, said roller is rolled reciprocally across said face.

Optionally, said printhead is an inkjet printhead.

Optionally, said printhead is a pagewidth printhead.

In a twelfth aspect the present invention provides a printhead maintenance station for maintaining a printhead in an operable condition, said maintenance station comprising:

an elastically deformable pad having a contact surface for sealing engagement with an ink ejection face of said printhead; and an engagement mechanism for reciprocally moving said pad between a first position in which said contact surface is sealingly engaged with said face, and a second position in which said contact surface is disengaged from said face, wherein said engagement mechanism is configured to move said pad rotatably with respect to said printhead such that, during engagement, a first part of said surface is contacted with said face prior to a second part of said surface, and during disengagement said second part is disengaged from said face prior to said first part.

Optionally, said pad is substantially coextensive with said printhead.

Optionally, said contact surface is substantially uniform.

Optionally, said pad is comprised of silicone, polyurethane, Neoprene®, Santoprene® or Kraton®.

Optionally, said pad is substantially cuboid.

Optionally, a peel zone between said contact surface and said ink ejection face advances and retreats longitudinally along said face during engagement and disengagement.

Optionally, said pad is fixed to an arm and said arm is rotatably mounted about a pivot, wherein said pivot is substantially parallel with a transverse axis of said printhead.

Optionally, said pad is biased towards said first position.

Optionally, said contact surface is progressively contacted with said face during sealing engagement and peeled away from said face during disengagement.

Optionally, said peeling disengagement draws ink from said printhead towards an edge portion of said contact surface and/or said face.

In a further aspect there is provided a maintenance station, further comprising an ink removal system for removing ink from an edge portion of said contact surface and/or said face.

Optionally, said ink removal system comprises a wicking element or wicking channel positioned adjacent an edge of said printhead.

Optionally, said wicking element or wicking channel is positioned to receive ink from said edge portion of said contact surface when said contact surface is being disengaged from said face.

Optionally, said ink removal system further comprises an ink collector for receiving ink wicked through said wicking element or wicking channel.

Optionally, said printhead is an inkjet printhead.

Optionally, said printhead is a pagewidth printhead.

In a thirteenth aspect the present invention provides a printhead maintenance station for maintaining a printhead in an operable condition, said maintenance station comprising:

an elastically deformable pad having a contact surface for sealing engagement with an ink ejection face of said printhead; and an engagement mechanism for reciprocally moving said pad between a first position in which said contact surface is sealingly engaged with said face, and a second position in which said contact surface is disengaged from said face, wherein said engagement mechanism is configured to move said pad rotatably with respect to said printhead such that, during engagement, a first part of said surface is contacted with said face prior to a second part of said surface, and during disengagement said second part is disengaged from said face prior to said first part.

Optionally, said pad is substantially coextensive with said printhead.

Optionally, said contact surface is substantially uniform.

Optionally, said pad is comprised of silicone, polyurethane, Neoprene®, Santoprene® or Kraton®.

Optionally, said pad is substantially cuboid.

Optionally, a peel zone between said contact surface and said ink ejection face advances and retreats longitudinally along said face during engagement and disengagement.

Optionally, said pad is fixed to an arm and said arm is rotatably mounted about a pivot, wherein said pivot is substantially parallel with a transverse axis of said printhead.

Optionally, said pad is biased towards said first position.

Optionally, said contact surface is progressively contacted with said face during sealing engagement and peeled away from said face during disengagement.

Optionally, said peeling disengagement draws ink from said printhead towards an edge portion of said contact surface and/or said face.

In a further aspect there is provided a maintenance station, further comprising an ink removal system for removing ink from an edge portion of said contact surface and/or said face.

Optionally, said ink removal system comprises a wicking element or wicking channel positioned adjacent an edge of said printhead.

Optionally, said wicking element or wicking channel is positioned to receive ink from said edge portion of said contact surface when said contact surface is being disengaged from said face.

Optionally, said ink removal system further comprises an ink collector for receiving ink wicked through said wicking element or wicking channel.

Optionally, said printhead is an inkjet printhead.

Optionally, said printhead is a pagewidth printhead.

In a fourteenth aspect the present invention provides a printhead maintenance station for maintaining a printhead in an operable condition, said maintenance station comprising:

an elastically deformable pad having a contact surface for sealing engagement with an ink ejection face of said printhead; and an engagement mechanism for moving said pad between a first position in which said contact surface is sealingly engaged with said face, a second position in which said contact surface is disengaged from said face, and a third position in which said contact surface is engaged with a pad cleaner.

Optionally, said maintenance station is configured such that said contact surface is progressively contacted with said face during sealing engagement and peeled away from said face during disengagement.

Optionally, said pad is substantially coextensive with said printhead.

Optionally, said contact surface is substantially uniform.

Optionally, said pad is comprised of silicone, polyurethane, Neoprene®, Santoprene® or Kraton®.

Optionally, a peel zone between said contact surface and said ink ejection face advances and retreats transversely across said face during engagement and disengagement.

Optionally, said engagement mechanism moves said pad linearly between said first and second positions, said linear movement being substantially perpendicular to said ink ejection face.

Optionally, said contact surface is sloped with respect to said ink ejection face such that, during engagement, a first part of said surface is contacted with said face prior to a second part of said surface.

Optionally, said pad is biased towards said first position relative to said second position.

Optionally, said peeling disengagement draws ink from said printhead towards an edge portion of said contact surface and/or said face.

Optionally, said engagement mechanism rotates said pad between said second and third positions.

Optionally, said engagement mechanism comprises a cam surface for abutment with a cradle on which said pad is mounted, said abutment causing rotation of said cradle from said second position to said third position.

Optionally, said pad is biased towards said second position relative to said third position.

Optionally, said pad cleaner is positioned remotely from said printhead.

Optionally, said maintenance station further comprises said pad cleaner.

Optionally, said pad cleaner is positioned for removing ink deposited on said contact surface from said printhead.

Optionally, said pad cleaner comprises a squeegee or an absorbent pad.

Optionally, said printhead is an inkjet printhead.

Optionally, said printhead is a pagewidth printhead.

In a fifteenth aspect the present invention provides a method of maintaining a printhead in an operable condition, said method comprising the steps of:

providing an elastically deformable pad having a contact surface for sealing engagement with an ink ejection face of said printhead; and moving said pad between a first position in which said contact surface is sealingly engaged with said face, a second position in which said contact surface is disengaged from said face, and a third position in which said contact surface is engaged with a pad cleaner.

Optionally, said movement causes said contact surface to be progressively contacted with said face during sealing engagement and peeled away from said face during disengagement.

Optionally, said pad is substantially coextensive with said printhead.

Optionally, said contact surface is substantially uniform.

Optionally, said pad is comprised of silicone, polyurethane, Neoprene®, Santoprene® or Kraton®.

Optionally, a peel zone between said contact surface and said ink ejection face advances and retreats transversely across said face during engagement and disengagement.

Optionally, said pad is moved linearly between said first and second positions, said linear movement being substantially perpendicular with respect to said ink ejection face.

Optionally, said contact surface is sloped with respect to said ink ejection face such that, during engagement, a first part of said surface is contacted with said face prior to a second part of said surface.

Optionally, a peel zone between said contact surface and said ink ejection face advances and retreats longitudinally along said face during engagement and disengagement.

Optionally, said pad is biased towards said first position relative to said second position.

Optionally, said peeling disengagement draws ink from said printhead towards an edge portion of said contact surface and/or said face.

Optionally, said pad is rotated between said second and third positions.

Optionally, said rotation is caused by abutment of a cradle on which said pad is mounted with a cam surface.

Optionally, said pad is biased towards said second position relative to said third position.

Optionally, said pad cleaner is positioned remotely from said printhead.

Optionally, said pad cleaner is positioned for removing ink deposited on said contact surface from said printhead.

Optionally, said pad cleaner comprises a squeegee or an absorbent pad.

Optionally, a sequential printhead maintenance cycle is performed, said maintenance cycle comprising the steps of:

(a) linearly moving said pad from said second position to said first position;

(b) linearly moving said pad from said first position to said second position;

(c) rotating said pad from said second position to said third position;

(d) rotating said pad from said third position back to said second position;

(e) optionally repeating steps (a)-(d) until said printhead is fully operable.

Optionally, said printhead is an inkjet printhead.

Optionally, said printhead is a pagewidth printhead.

In a sixteenth aspect the present invention provides a printhead assembly comprising:

a printhead mounted on a support, said printhead having an ink ejection face; and a film cooperating with said support to define a wicking channel, wherein said wicking channel is positioned for receiving ink from an edge portion of said printhead and/or an edge portion of a pad being disengaged from said face.

Optionally, said film defines a tapered wicking channel.

Optionally, a channel inlet is proximal to said printhead and a channel outlet is distal from said printhead.

Optionally, said channel is tapered towards said channel outlet.

Optionally, a proximal edge portion of said film at least partially defines said channel inlet and a distal edge portion of said film at least partially defines said channel outlet.

Optionally, said film is anchored to said support along said distal edge portion.

Optionally, a plurality of anchor points are spaced apart along said distal edge portion.

Optionally, said distal edge portion of said film is attached to a print media guide.

Optionally, said distal edge portion of said film is sandwiched between said print media guide and said support.

Optionally, said channel outlet is in fluid communication with an ink collector.

Optionally, said film is substantially coextensive with said printhead and positioned adjacent a longitudinal edge of said printhead.

Optionally, a plurality of vents are defined in said film, said vents being positioned for receiving ink from an outer surface of said film.

Optionally, said vents are positioned towards said channel inlet.

Optionally, each vent is an elongate slot extending substantially parallel with a longitudinal edge of said film.

Optionally, said film is resiliently displaceable.

Optionally, said printhead is wirebonded along a longitudinal edge portion and said film is positioned adjacent an opposite longitudinal edge portion of said printhead.

In a further aspect there is provided a printhead assembly, further comprising a print media guide mounted on said support, said film channeling ink into a cavity defined between said guide and said support.

In a further aspect there is provided a printhead assembly, further comprising a printhead maintenance station, said maintenance station comprising:

a pad having a sloped contact surface for engagement with said ink ejection face; and an engagement mechanism for moving said pad between a first position in which said contact surface is sealingly engaged with said face, and a second position in which said contact surface is disengaged from said face, said engagement mechanism moving said pad substantially perpendicularly with respect to said face.

Optionally, an edge portion of said pad extends beyond an edge of said printhead, such that at least part of said pad abuts said film when said pad is engaged with said face.

Optionally, said channel is resiliently defined as said pad disengages from said face.

In a seventeenth aspect the present invention provides a method of removing ink from an ink ejection face of a printhead, said method comprising the steps of:

(a) moving said ink towards an edge portion of said printhead; and (b) wicking said ink away from said edge portion.

Optionally, said edge portion is a longitudinal edge portion.

Optionally, said printhead is wirebonded along a longitudinal edge portion and ink is moved towards an opposite longitudinal edge portion.

Optionally, said ink is moved using peeling action.

Optionally, said peeling action is provided by a pad being peeled away from said face.

Optionally, said pad has a sloped contact surface relative to said face.

Optionally, said ink is wicked into an ink collector.

Optionally, said ink is wicked through a wicking channel.

Optionally, said wicking channel is tapered.

Optionally, said wicking channel is defined at least partially by a film.

Optionally, a channel inlet is proximal to said edge portion and a channel outlet is distal from said edge portion, said channel being tapered towards said channel outlet.

Optionally, said film is substantially coextensive with said printhead and positioned adjacent a longitudinal edge portion of said printhead.

Optionally, a plurality of vents are defined in said film, said vents being positioned for receiving ink from an outer surface of said film.

Optionally, said film is a polymer film.

Optionally, said film is resiliently displaceable.

Optionally, said ink is wicked through a wicking element.

Optionally, said wicking element is comprised of an absorbent material.

Optionally, said wicking element is positioned adjacent said edge portion.

Optionally, said printhead is a pagewidth inkjet printhead.

BRIEF DESCRIPTION OF THE DRAWINGS

Specific forms of the present invention will be now be described in detail, with reference to the following drawings, in which:-

DETAILED DESCRIPTION OF SPECIFIC EMBODIMENTS

Contact Angle Hysteresis

In general terms, and as mentioned above, the present invention relies on an understanding of contact angles—specifically, a hysteresis between advancing and receding contact angles.

Figure 1:
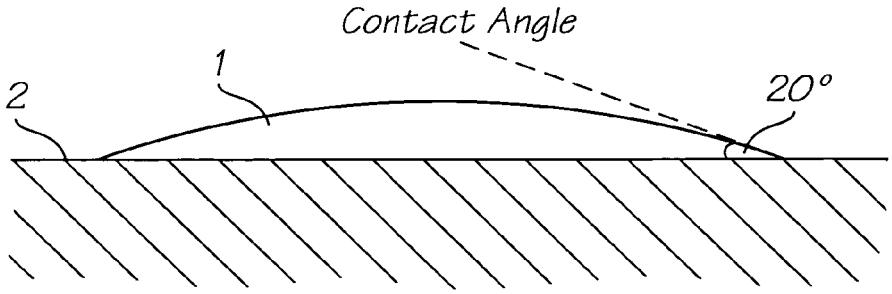
FIG. 1 shows an equilibrium contact angle for a wetting droplet of liquid on a surface.
Figure 2:
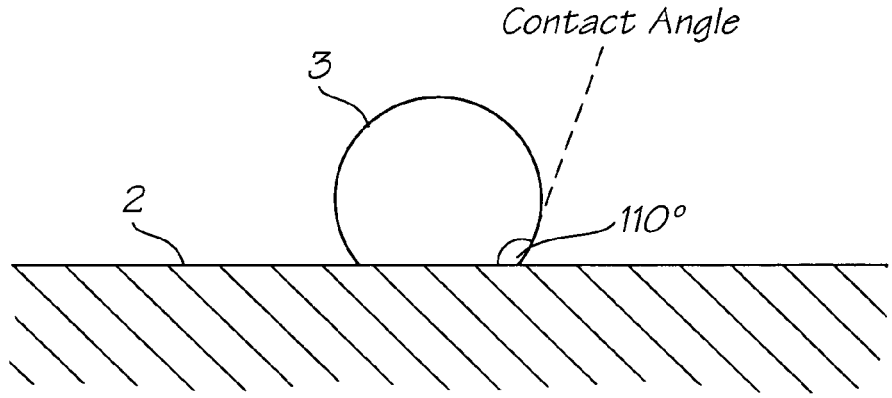
FIG. 2 shows an equilibrium contact angle for a non-wetting droplet of liquid on a surface.

The shape of a droplet of liquid on a solid surface is determined by its contact angle(s). Depending on factors such as the surface tension in the liquid and the interactive forces between the solid and the liquid, the shape of the droplet will change. FIG. 1 shows a droplet of liquid 1 having a contact angle of 20° on a solid surface 2. With acute contact angles, the liquid is said to be "mostly wetting" the surface 2. FIG. 2 shows a droplet of another liquid 3 having a contact angle of 110° on the solid surface 2. With obtuse contact angles, the liquid is said to be "mostly non-wetting".

The contact angles shown in FIGS. 1 and 2 are static or equilibrium contact angles. Since the droplet is symmetrical, the contact angle measured on either side of the droplet would be the same.

Figure 3:
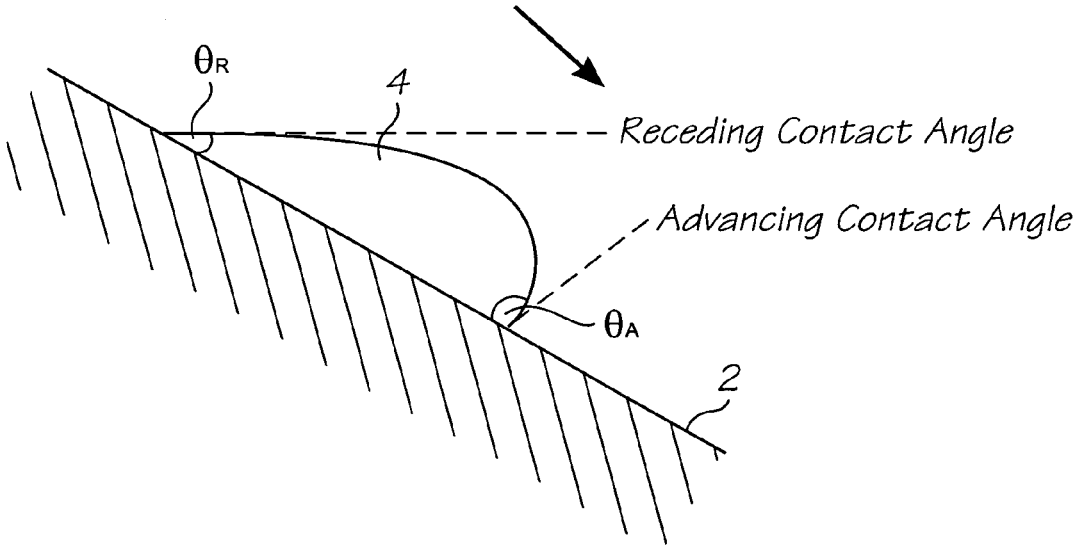
FIG. 3 shows advancing and receding contact angles for a droplet of liquid moving along a surface.

However, the situation changes if the droplet of liquid is moving. FIG. 3 shows a droplet of liquid 4 moving down the surface 2, which is now sloped. As shown in FIG. 3, the shape of the droplet changes when it is moving. The result is that the contact angle on its leading (advancing) edge is greater than the contact on its tailing (receding) edge. In other words, the droplet is more wetting when receding and less wetting when advancing. The contact angle designated as $\theta_A$ in FIG. 3 is called the Advancing Contact Angle, and the contact angle designated as $\theta_R$ in FIG. 3 is called the Receding Contact Angle.

For a typical droplet of ink moving across a silicone surface, the advancing contact angle is about 90°, whereas the receding contact angle is about 15°. Without wishing to be bound by theory, it is understood by the present inventors that this contact angle hysteresis is responsible for the cleaning action provided by the present invention.

Figure 4A:
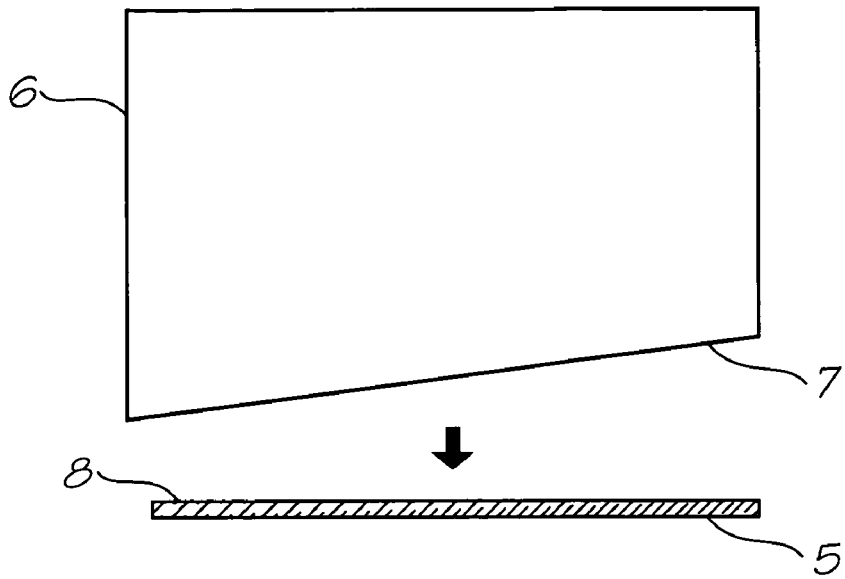
FIG. 4A is a side view of a contact surface before engagement with an ink ejection face of a printhead.
Figure 4B:
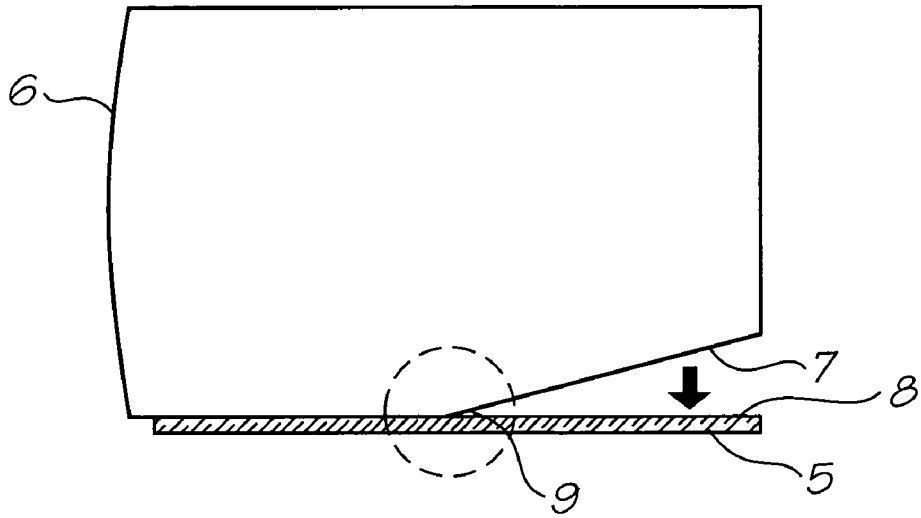
FIG. 4B is a side view of a contact surface partially engaged with the ink ejection face during engagement.
Figure 4C:
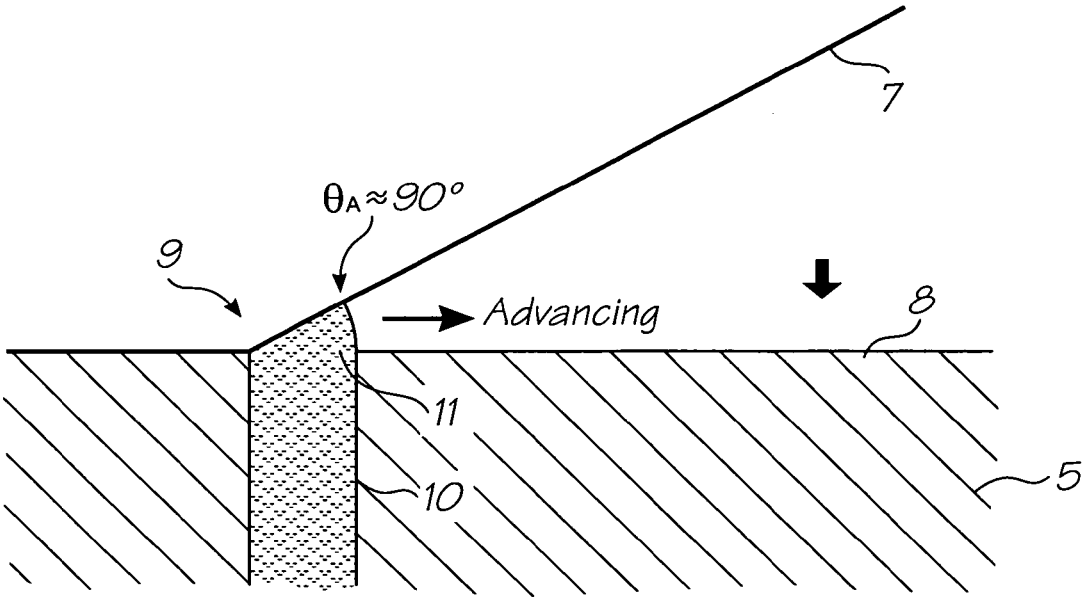
FIG. 4C shows in detail a peel zone between the contact surface and a printhead nozzle during engagement.
Figure 4D:
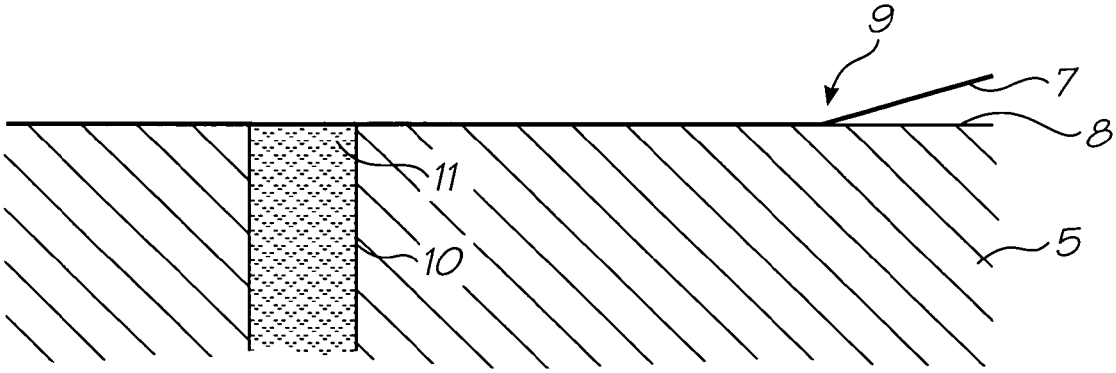
FIG. 4D shows in detail the peel zone in FIG. 4C after it has advanced past the nozzle.

In FIGS. 4A and 4B, a flexible pad 6 having a contact surface 7 is progressively brought into contact with a printhead 5 having an ink ejection face 8. FIG. 4C shows an exploded view of a peel zone 9 in FIG. 4B, when the contact surface 7 is partially in contact with the ink ejection face 8. FIG. 4C shows in detail the behavior of ink 11 as the surface 7 is contacted with a nozzle opening 10 on the printhead. Ink 11 in the nozzle opening 10 makes contact with the contact surface 7 as it advances across the printhead 5. However, since the advancing contact angle $\theta_A$ of the ink 11 on the contact surface 7 is relatively non-wetting (about 90°), the ink has little or no tendency to wet onto the contact surface 7. Hence, as shown in FIG. 4D, the ink 111 remains on the ink ejection face 8 or in the nozzle 10, and the peel zone 9 advancing across the ink ejection face is relatively dry.

Figure 5A:
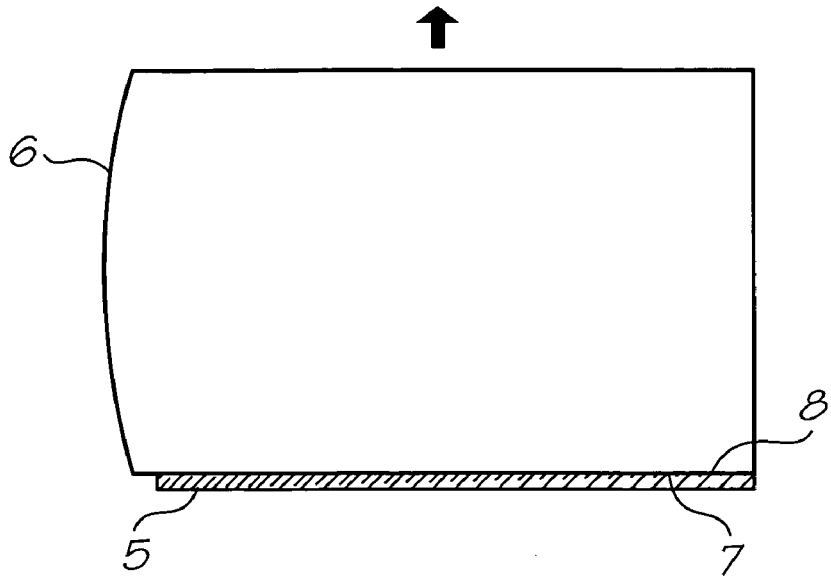
FIG. 5A is a side view of the contact surface sealingly engaged with the ink ejection face.
Figure 5B:
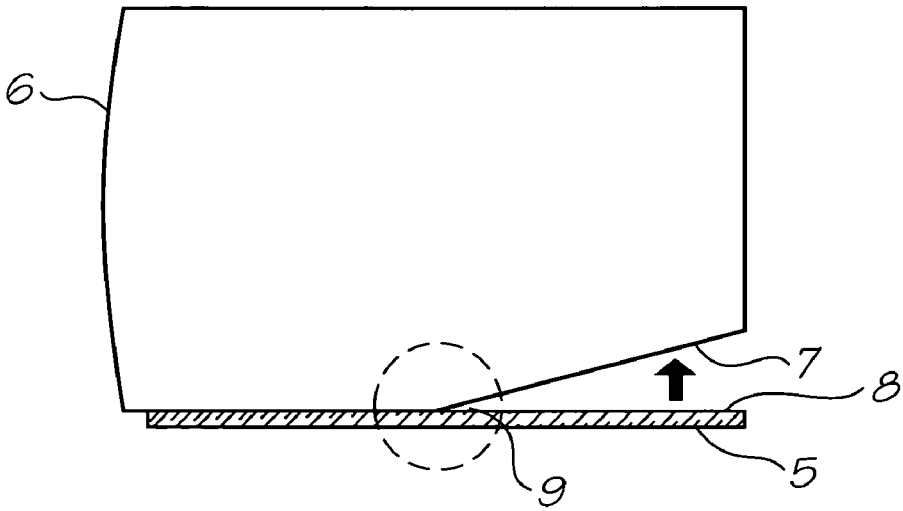
FIG. 5B is a side view of a contact surface partially engaged with the ink ejection face during disengagement.
Figure 5C:
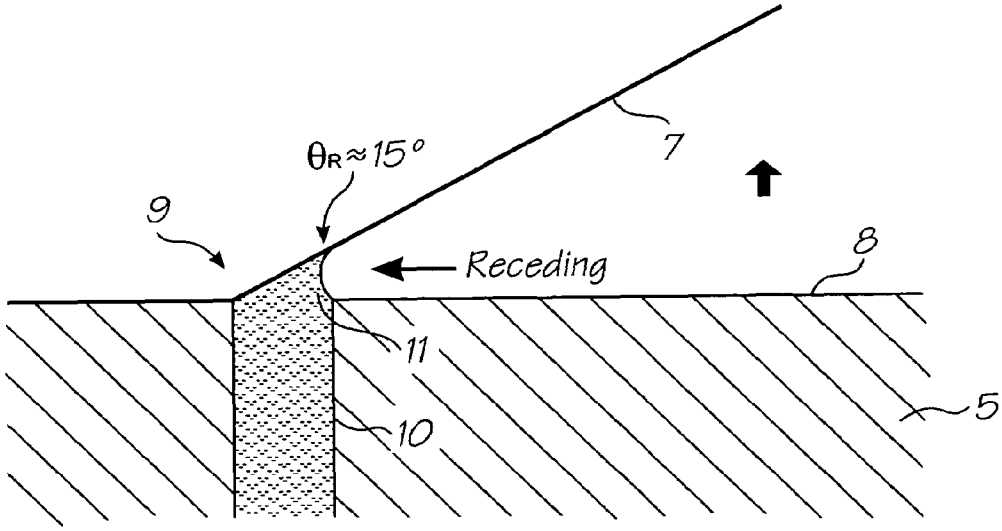
FIG. 5C shows in detail a peel zone between the contact surface and a printhead nozzle during disengagement.
Figure 5D:
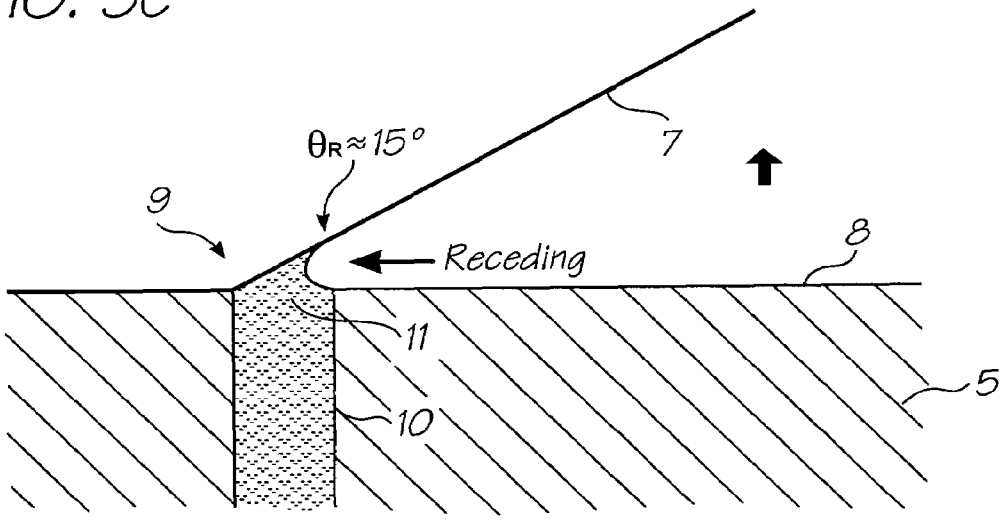
FIG. 5D shows in detail the peel zone in FIG. 4C as it retreats from the nozzle.
Figure 5E:
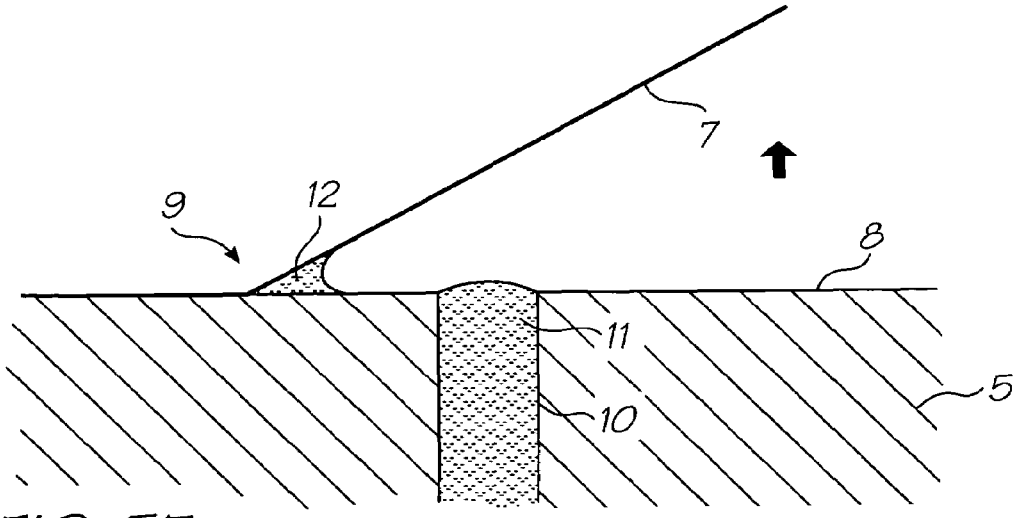
FIG. 5E shows in detail the peel zone in FIG. 4D after it has retreated from the nozzle.

In FIGS. 5A and 5B, the reverse process is shown as the flexible pad 6 is peeled away from the ink ejection face 8. Initially, as shown in FIG. 5A, the contact surface 7 is sealingly engaged with the ink ejection face 8. In FIG. 5B, the contact surface 7 is peeled away from the ink ejection face 8, and the peel zone 9 retreats across the face. FIG. 5C shows a magnified view of the peel zone 9 as the contact surface 7 is peeled away from the nozzle opening 10 on the printhead 5. Ink 11 in the nozzle opening 10 makes contact with the contact surface 7 as it recedes across the ink ejection face 8. However, since the receding contact angle $\theta_R$ of the ink 11 on the surface 7 is relatively wetting (about 15°), the ink in the nozzle opening 10 now tends to wet onto the contact surface 7. Hence, as shown in FIGS. 5D and 5E, the peel zone 9 retreating across the ink ejection face 8 is wet, carrying with it a droplet of ink 12 drawn from the nozzle opening 10 or from the ink ejection face 8. This has the effect of clearing blocked nozzles in the printhead 5 and cleaning ink flooded on the ink ejection face 8.

Figure 6:
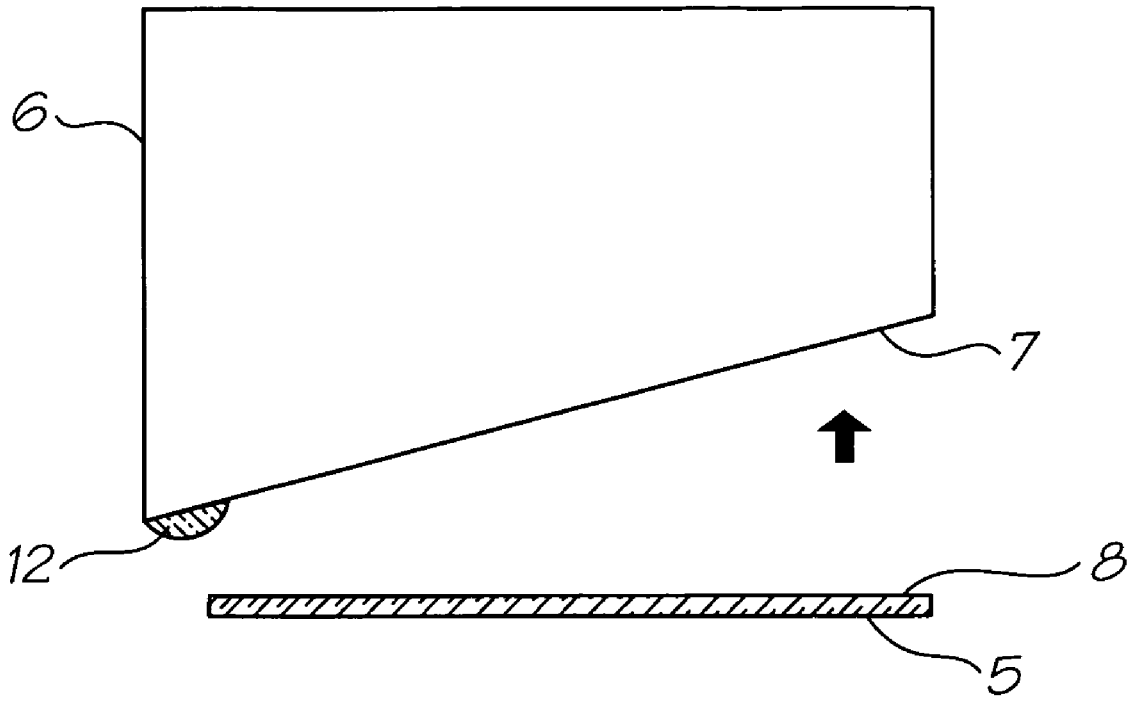
FIG. 6 is a side view of the contact surface immediately after it has disengaged from the ink ejection face.

FIG. 6 shows the flexible pad 6 as the last part of the contact surface 7 is peeled away from the ink ejection face 8. The contact surface 7 has collected a bead of ink 12 at the final point of contact with the printhead 5.

As will be readily appreciated from the foregoing discussion, the present invention may be implemented in many different forms, provided that the contact surface 7 is contacted with the ink ejection face 8 so as to produce a contact angle hysteresis. Various forms of the invention are described in detail below.

Printhead Maintenance Station Having Linear Pad Movement

Referring to FIGS. 7 to 11, a printhead maintenance station 20 comprises an elastically deformable pad 6 having a contact surface 7. The pad 6 is mounted on a support 23, having a recess 24 for receiving the pad. The support 23 is mounted on a support arm 25 having lugs 26 protruding from each end. The pad 6, support 23 and support arm 25 are bonded together to form a pad sub-assembly.

A housing 30 comprises a body 31 and a cap 32, which is snap-fitted to the body with a plurality of snap-locks 33. The two-part construction of the housing 30 enables it to be assembled by receiving the pad sub-assembly in the body 31 and then snap-fitting the cap 32 onto the body. The lugs 26 protruding from each end of the support arm 25 are received in complementary slots 34 in the housing 30. Accordingly, the support arm 25 is slidably movable within the slots 34, allowing the pad 6 to move slidably relative to the housing 30.

The extent of movement of the pad 6 is defined by the slots 34. In a first position shown in FIG. 7, the lugs 26 abut an upper end 37 of each slot 34 and the pad 6 protrudes, at least partially, from the housing 30. In a second position (not shown), the lugs 26 abut a lower end 38 of each slot 34, defined by the cap 32, and the pad 6 is withdrawn inside the housing 30.

Figure 11:
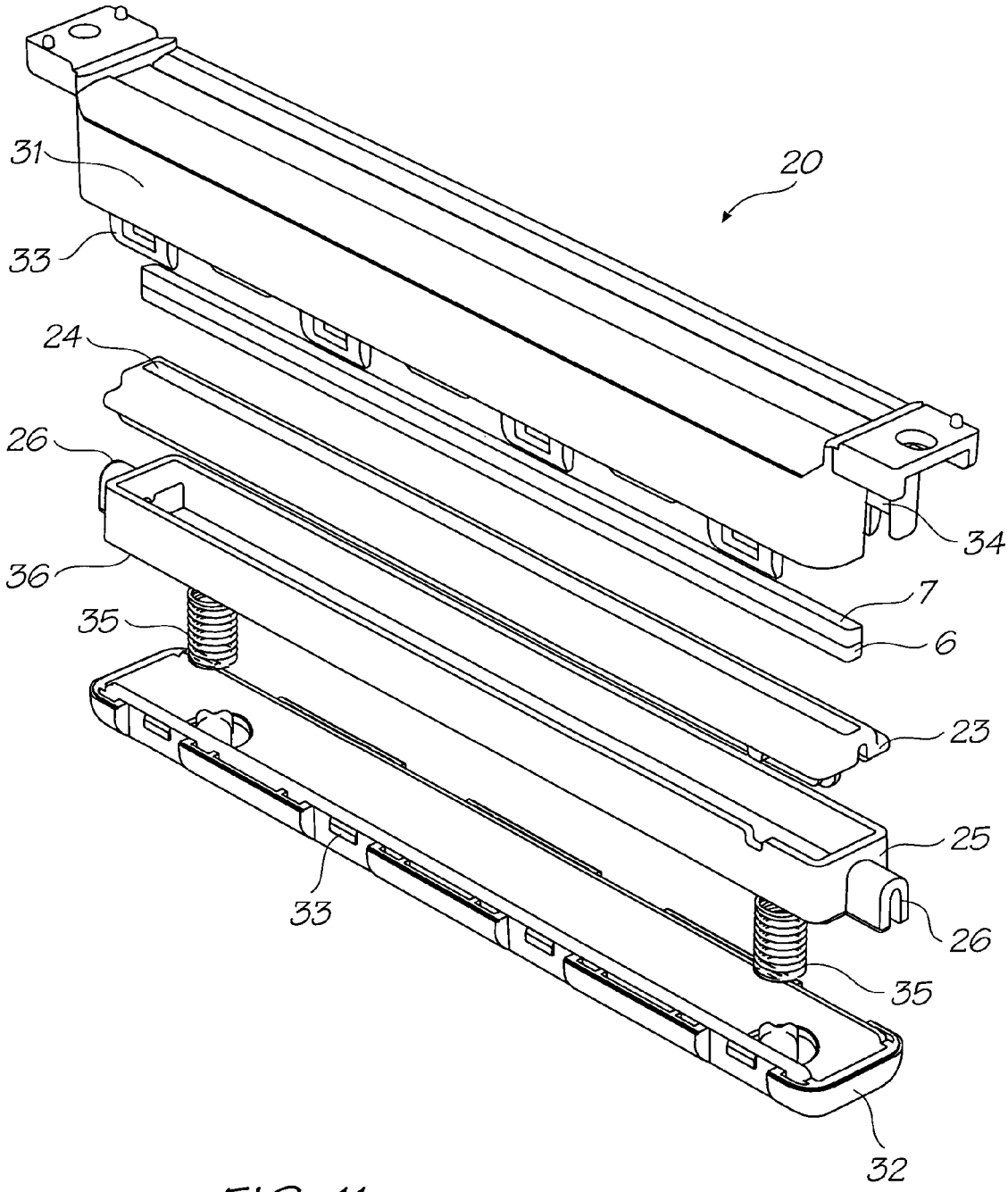
FIG. 11 is an exploded perspective view of the printhead maintenance station shown in FIG. 7.

As shown in FIG. 11, a pair of springs 35 are fixed to the cap 32 and urge against a lower surface 36 of the support arm 25. The springs 35 bias the pad 6 towards the first position shown in FIG. 7.

Figure 7:
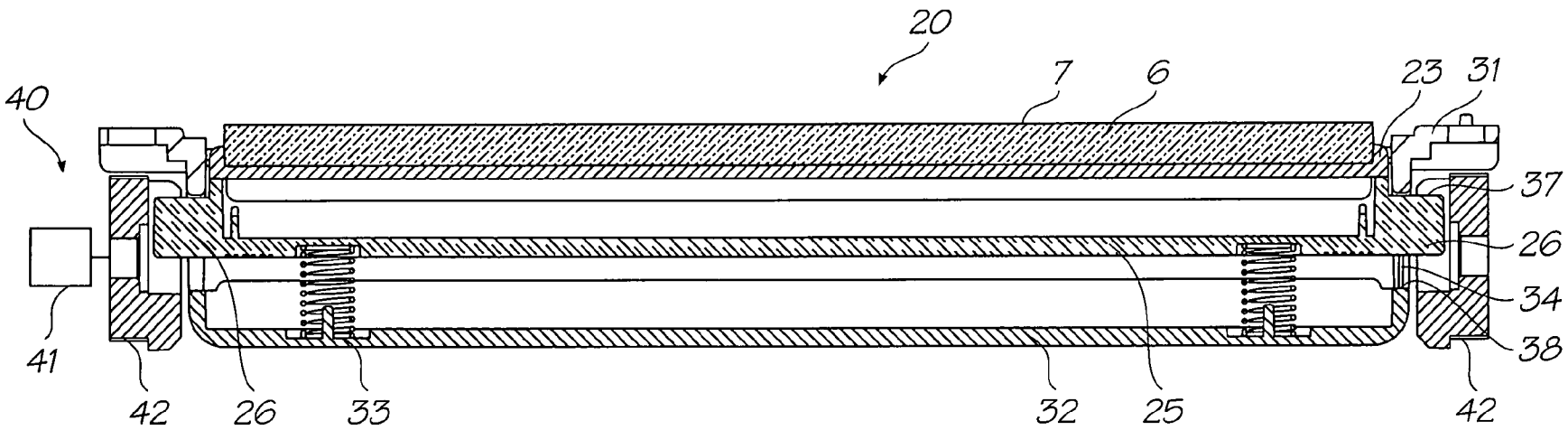
FIG. 7 is a longitudinal side section view through a printhead maintenance station according to the invention.
Figure 8:
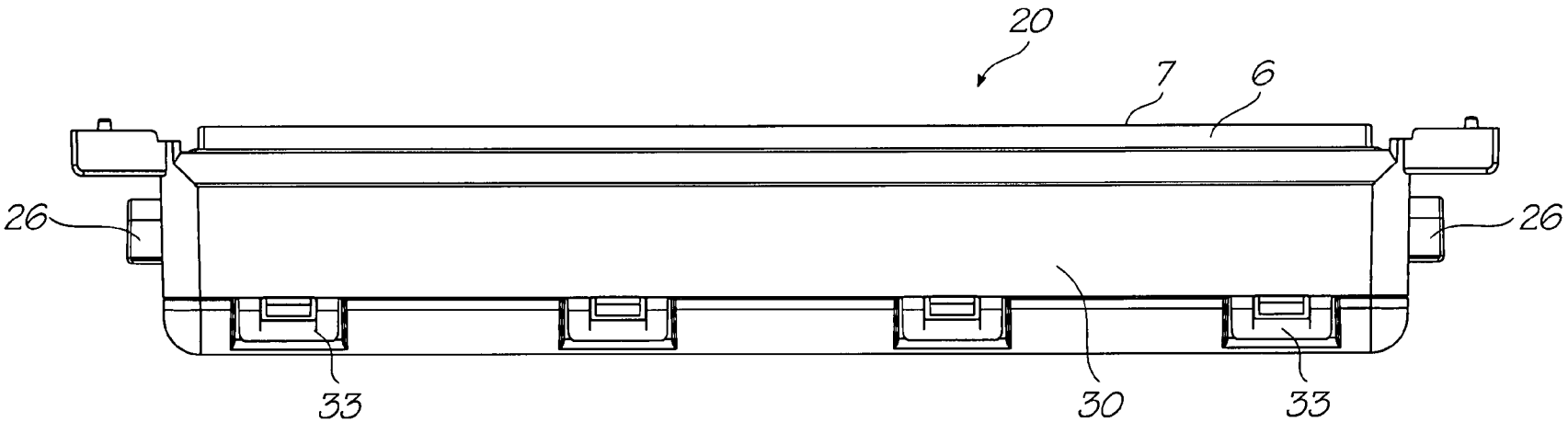
FIG. 8 is a side view of the printhead maintenance station shown in FIG. 7.
Figure 9:
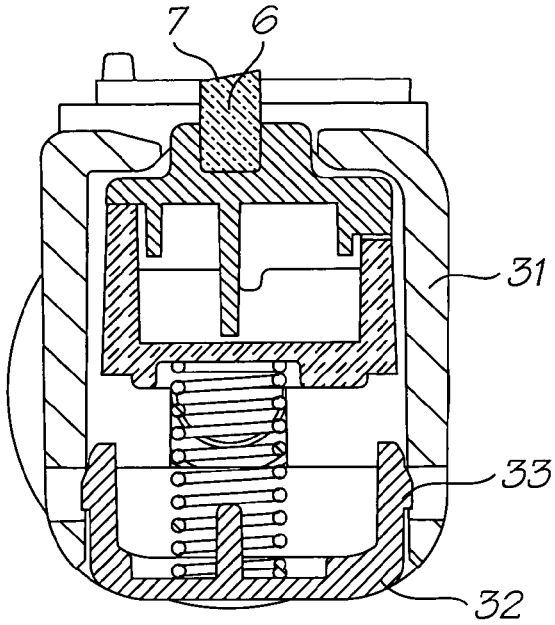
FIG. 9 is a transverse side section view of the printhead maintenance station shown in FIG. 7.
Figure 10:
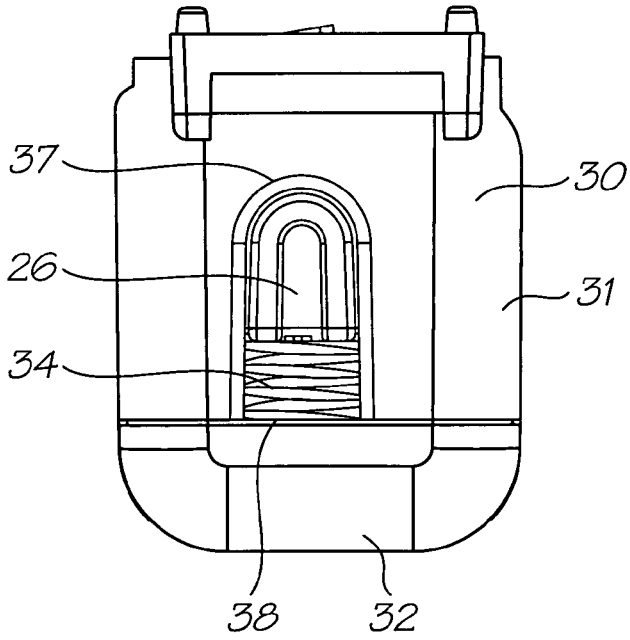
FIG. 10 is an end view of the printhead maintenance station shown in FIG. 7.

The pad 6 is movable between the first and second positions by means of an engagement mechanism 40, which is shown in FIG. 7. The engagement mechanism 40 comprises a motor 41, which rotates a pair of cams 42, engaged with respective lugs 26 at each end of the support arm 25. Rotation of the motor 41 and the cam 42 causes linear sliding movement of the support arm 25 and, hence, the pad 6. Accordingly, the pad 6 may be moved reciprocally between the first and second positions upon actuation of the motor 41.

In the first position, the contact surface 7 is sealingly engaged with the ink ejection face 8, as shown in detail in FIG. 5A. In the second position, the contact surface 7, is disengaged from the ink ejection 8, as shown in FIG. 4A. In between these two positions, the contact surface 7 may be either progressively contacting or peeling away from the ink ejection face 8.

Figure 12:
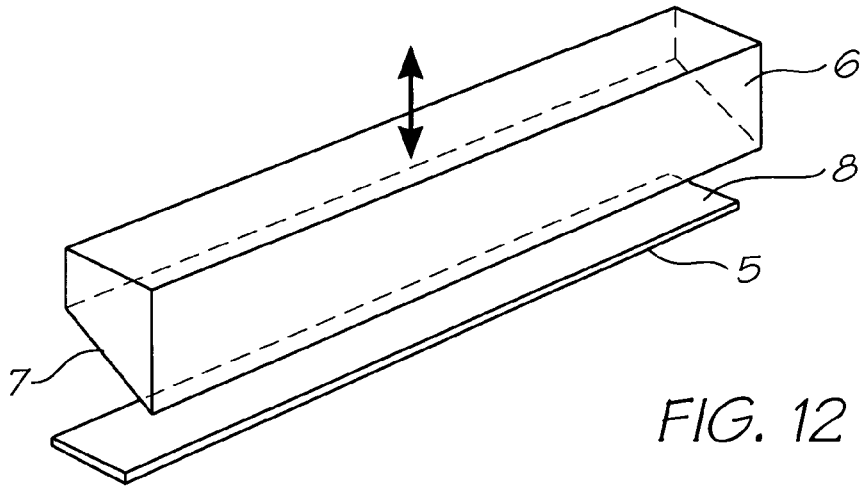
FIG. 12 is a perspective view of a pad moving perpendicularly with respect to an ink ejection face of a printhead.

FIG. 12 shows the perpendicular movement of the pad 6 with respect to the ink ejection face 8. As discussed above, this movement together with the profile of the contact surface 7 allows the printhead 5 to be maintained in an operable condition by sealing, cleaning and/or nozzle-clearing actions.

Alternative Pad Configurations

In the embodiment shown in FIGS. 4-12, the pad 6 is moved linearly and substantially perpendicularly with respect to the ink ejection face 8. The pad 6 is shown in FIGS. 4A and 12 having a sloped contact surface 7 in the form of a straight-line gradient. This sloped contact surface 7 allows it to be progressively contacted with and peeled away from the ink ejection face 8 during engagement and disengagement respectively.

Figure 13:
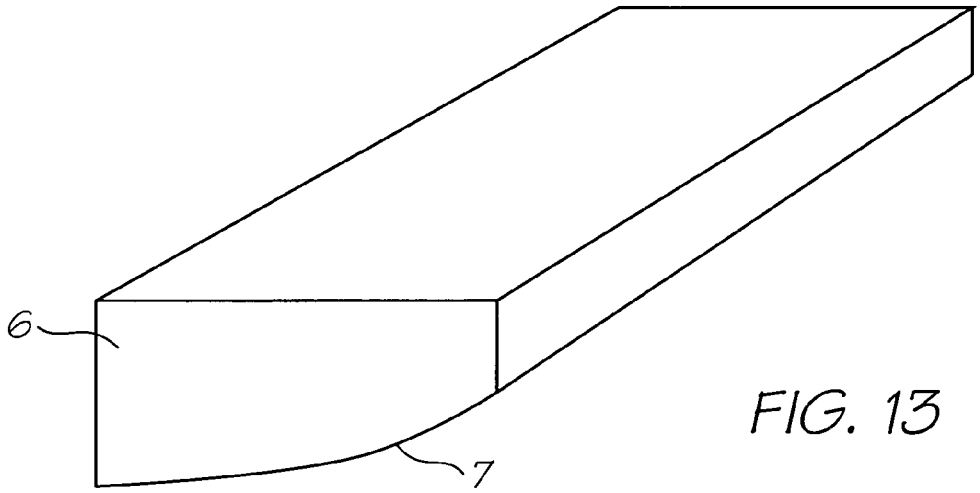
FIG. 13 is a perspective view of a pad.
Figure 14:
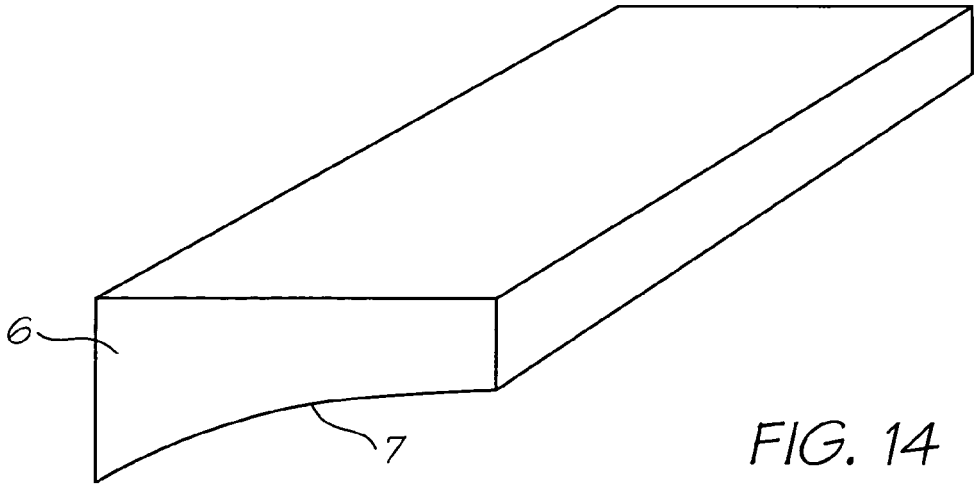
FIG. 14 is a perspective view of a pad.

However, the contact surface may adopt other profiles and still achieve a similar effect when moved perpendicularly with respect to the ink ejection face 8. FIGS. 13 and 14 show two alternative configurations for the pad 6 in which the contact surface 7 has a curved profile in cross-section.

Figure 15A:
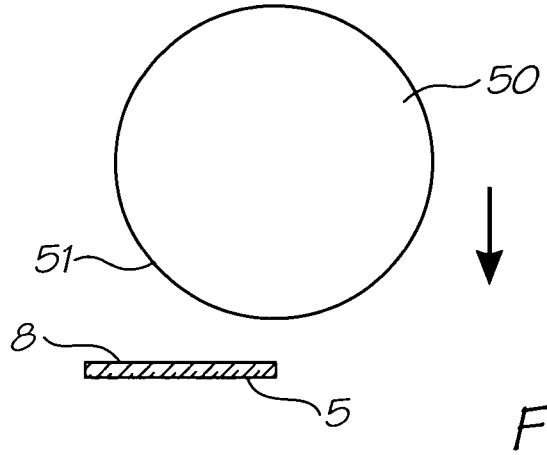
FIG. 15A-C are schematic side views of a cylindrical pad at various stages of engagement with an ink ejection face of a printhead.
Figure 15B:
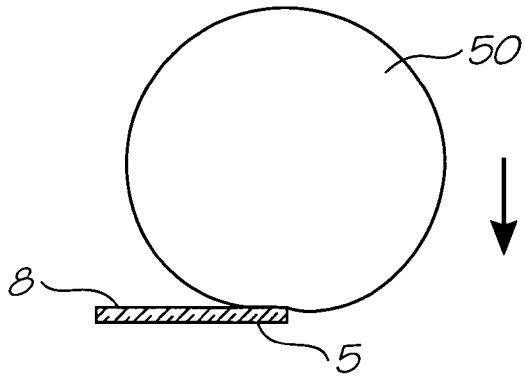
Figure 15C:
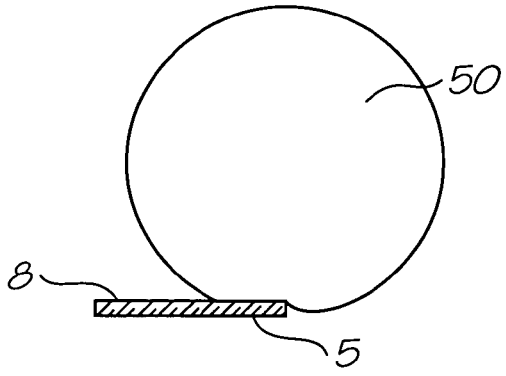

As shown in FIGS. 15A-C, the pad may alternatively be in the form of a cylinder 50, extending along the length of the printhead 5. The cylinder may be moved perpendicularly with respect to the ink ejection face 8 so that it is in either an engaged or a disengaged position. FIGS. 15A-C show progressive contacting of a curved contact surface 51 of the cylinder 50 so that it is brought into sealing engagement with the ink ejection face 8. The reverse process of peeling the contact surface 51 away from the ink ejection face 8 cleans the face or clears blocked nozzles on the printhead 5, as described above. The cylinder 50 is offset from the printhead 5 so that any ink drawn from the printhead moves towards an edge portion of the printhead during disengagement, and not towards the centre.

Any of these alternative pads may readily be incorporated into the printhead maintenance station 20 described above by simple replacement of the pad 6 in FIG. 11.

Printhead Maintenance Station Having Rotational Pad Movement

In all the embodiments described thus far, the contact surface 7 has been sloped. With a sloped contact surface 7, linear motion of the pad 6 produces the peeling action required by the invention.

However, as an alternative, the pad 6 may be moved rotationally in order to achieve the progressive engagement and peeling disengagement from the ink ejection face 8.

Figure 16A:
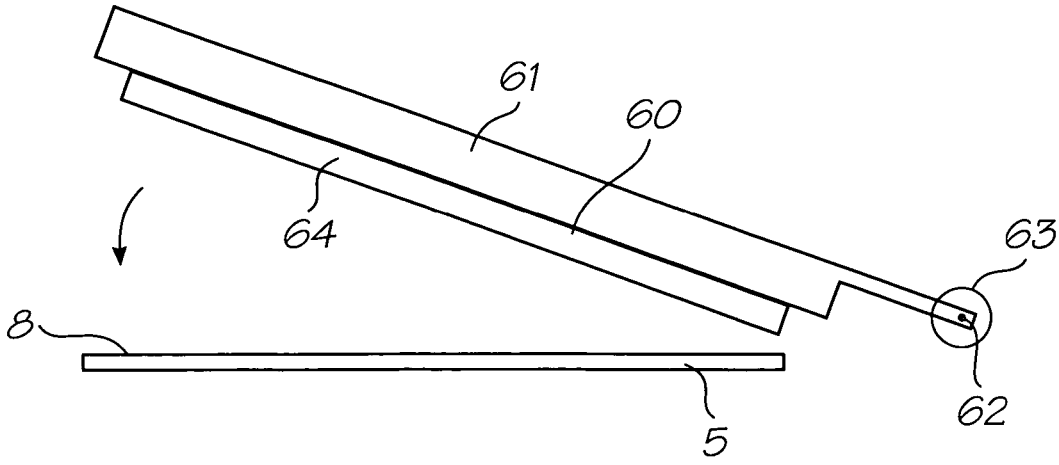
FIG. 16A-C are schematic side views of a contact surface being brought into engagement with an ink ejection face of a printhead by rotational movement.
Figure 16B:
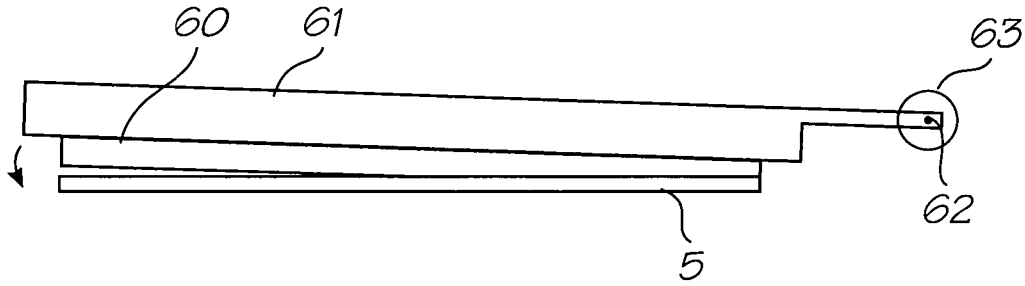
Figure 16C:
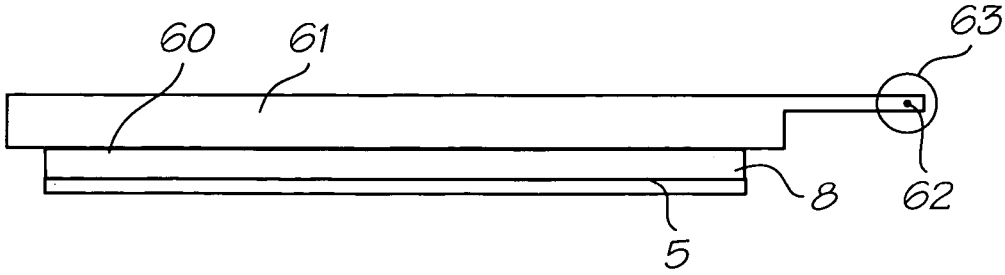

In FIGS. 16A-C, there is shown a pad 60 mounted on an arm 61, which is attached to a pivot 62 at one end. The arm 61 is rotated by means of a motor 63 connected to the pivot 62. The pad 60 has a flat contact surface 64, which is progressively contacted with the ink ejection face 8 by virtue of the rotational movement of the arm 61. In the reverse process (not shown), the pad 60 is peeled away from the ink ejection face 8 also by virtue of the rotational movement of the arm 61. The pad 60 may be cuboid-shaped in this embodiment, since the requisite engagement and disengagement action is generated by the rotational movement of the pad.

As shown in FIGS. 16A-C, the pad is progressively contacted (and, by the reverse process, peeled away) along the longitudinal direction of the printhead 5. The printhead 5 has longitudinal rows of nozzles (not shown), with each row ejecting the same colored ink. By engaging/disengaging the pad 60 along the longitudinal direction of the printhead 5, color mixing between adjacent rows of nozzles is minimized as ink is drawn longitudinally along the ink ejection face 8 towards a transverse edge portion of the face and the pad 60.

Printhead Maintenance Station Having Rolling Pad Movement

Figure 17:
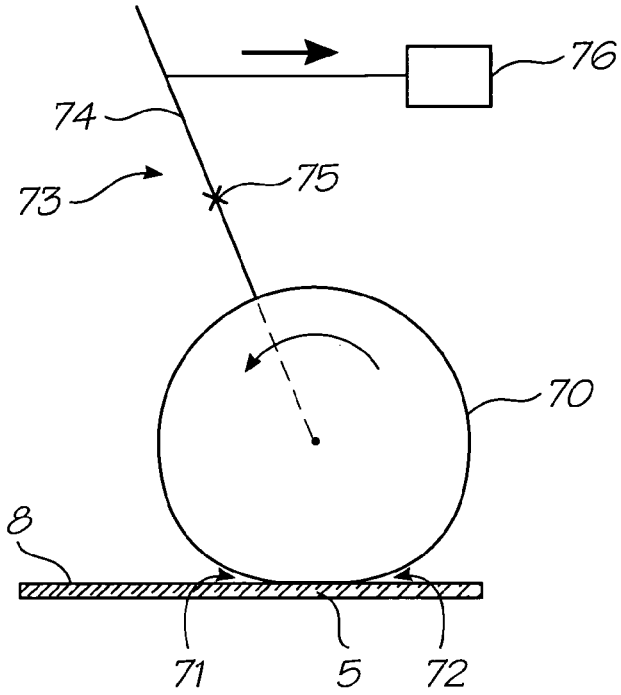
FIG. 17 is a schematic side view of a roller being rolled across an ink ejection face of a printhead.

As shown in FIG. 17, the pad may alternatively be in the form a roller 70, which extends along the length of the printhead 5. In this embodiment, the roller 70 is rolled transversely across the ink ejection face 8 so that a leading peel zone 71 between the roller and the face is dry, and a tailing peel zone 72 between the roller and the face is wet. As explained above, this difference is due to an advancing contact angle at the leading peel zone 71 being greater than a receding contact angle at the tailing peel zone 72. Accordingly, the rolling action has the effect of cleaning the ink ejection face 8 due to this contact angle hysteresis. Unlike the embodiments described above, in this embodiment, advancing and receding contact angles are experienced simultaneously by different surfaces of the roller 70.

The roller 70 is rolled across the ink ejection face using a rolling mechanism 73. The rolling mechanism 73 comprises a pivot arm 74 to which the roller 70 is rotatably mounted at one end. The pivot arm 74 is pivoted about a pivot 75, and an opposite end of the arm is moved by means of a solenoid 76. Actuation of the solenoid 76 causes the pivot arm 74 to pivot and the roller 70 is consequently rolled transversely across the ink ejection face 8.

Absorbent Wicking Element Adjacent Printhead for Removing Ink

In all the embodiments described above, the cleaning action of the pad 6 generally deposits ink towards a predetermined region of the contact surface 7, which is typically an edge portion. Some ink may also be deposited on an edge portion of the ink ejection face 8—either a transverse edge portion or a longitudinal edge portion depending on the configuration or movement of the pad 6.

Figure 18:
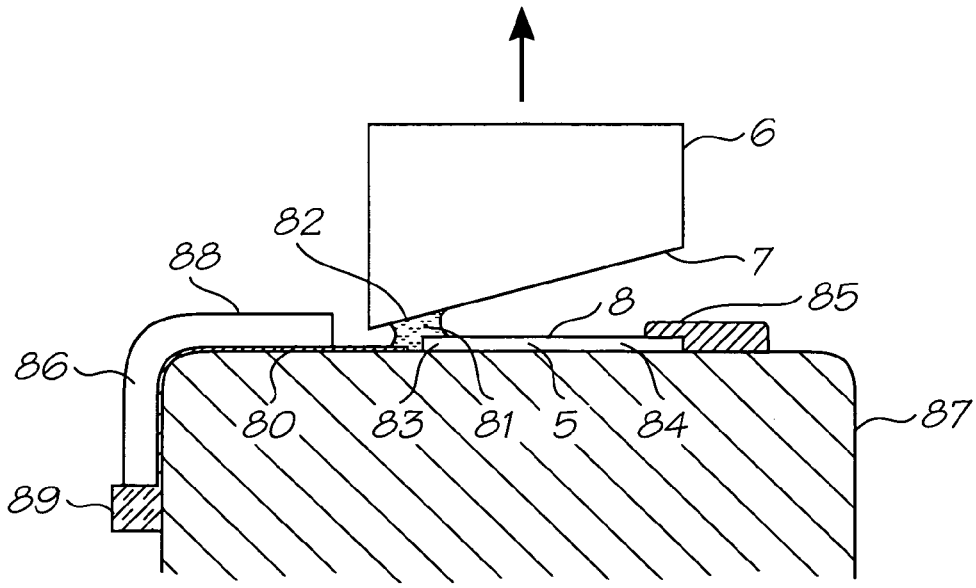
FIG. 18 is a schematic side view of a printhead assembly comprising a wicking element.

FIG. 18 shows an embodiment where deposited ink 81 is removed by means of a wicking element 80 positioned adjacent a longitudinal edge 83 of the printhead 5. The wicking element 80 wicks ink away from a longitudinal edge portion 82 of the contact surface 7 and/or the ink ejection face 8. From FIG. 18, it can be seen that the edge portion 82 of the contact surface 7 extends past an edge of the printhead 5, allowing ink 81 to contact with the wicking element 80 adjacent the printhead. Hence, ink deposited at the edge portion 82, as the contact surface 7 peels away from the ink ejection face 8, is transferred onto the wicking element 80. The edge portion 82 is the final point of contact between the contact surface 7 and the ink ejection face 8 during disengagement.

The pad 6 and wicking element 80 are configured to move ink away from an opposite longitudinal edge portion 84 of the printhead 5, which comprises wirebond encapsulant 85. The encapsulant 85 protects wirebonds (not shown) connecting the printhead 5 to other printer components (not shown).

The crowded environment around the printhead 5 means that the wirebonded edge portion 84 is relatively inaccessible. It is an advantage of the present invention that the pad 6 can access and move ink away from this severely crowded edge portion 84.

The wicking element 80 is formed from an absorbent material, such as paper or foam, and is positioned in a cavity defined between a print media guide 86 and a support 87 on which the printhead 5 and print media guide are mounted. The print media guide 86 has a guide surface 88 for guiding print media past the printhead 5 when the pad 6 is fully disengaged from the ink ejection face 8.

An ink collector 89 receives ink that has wicked through the wicking element 80, ensuring that ink is always removed away from the printhead 5.

Wicking Channel Adjacent Printhead for Removing Ink

With repeated maintenance operations, the wicking element 80 may become damaged after repeated engagement of the pad 6. In particular, if the wicking element 80 is comprised of paper and saturated with absorbed ink, it may disintegrate when contacted with the contact surface 7. Whilst more robust wicking materials may be used, a problem remains in that wicking rates through the material are relatively slow.

Figure 19:
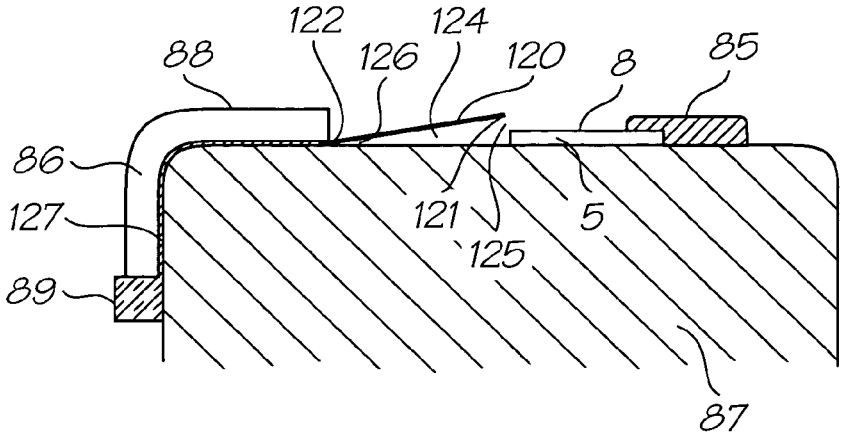
FIG. 19 is a schematic side view of a printhead assembly comprising a wicking channel.
Figure 20:
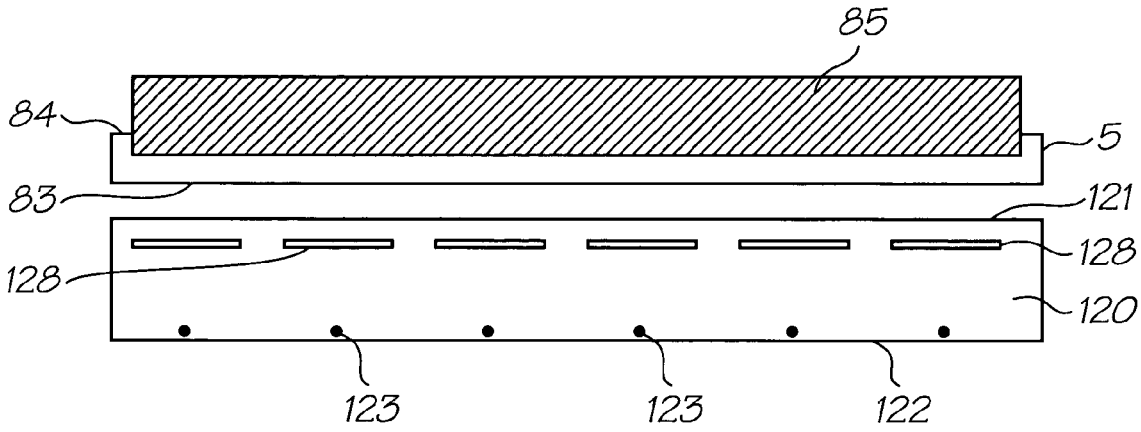
FIG. 20 is a plan view of the printhead and film shown in FIG. 19.

In an alternative embodiment, and referring to FIGS. 19 and 20, a film 120 is positioned adjacent the longitudinal edge 83 of the printhead 5. The film 120 has a proximal longitudinal edge 121 and a distal longitudinal edge 122 relative to the printhead 5. The film 120 cooperates with the support 87 to define a wicking channel 124. The distal longitudinal edge 122 may be attached to the support 87 via a plurality of anchor points 123. The anchor points 123 may be, for example, spots of adhesive spaced apart along the distal edge 122. Alternatively, the distal edge 122 of the film 120 may be fixed to the paper guide 86, and the film held in position by being sandwiched between the support 87 and the paper guide.

The film 120 is typically a biaxially oriented polyester film (e.g. Mylar® film). Due to the stiffness and resilience of the film 120, attachment to the support 87 along the distal longitudinal edge 122 provides a tapered wicking channel 124. A channel inlet 125 is provided adjacent the longitudinal edge 83 of the printhead 5, while a channel outlet 126 is provided distal from the printhead 5.

Due to the tapering of the wicking channel 124, ink received in the channel inlet 125 wicks rapidly along the channel towards the channel outlet 126 by capillary action, thereby removing ink away from the printhead 5. Furthermore, since the anchor points 123 are spaced apart along the distal longitudinal edge 122 of the film 120, ink can flow in between the anchor points and exit the channel outlet 126.

A secondary wicking element 127 is positioned between the media guide 86 and the support 87 at the channel outlet 126. The secondary wicking element 87 is positioned to receive ink from the channel outlet 126 and wicks ink into the ink collector 89. The secondary wicking element 127 is comprised of an absorbent material, such as paper or foam. Since the secondary wicking element 127 is not physically contacted by the pad 6 during printhead maintenance operations, it has a comparatively long lifetime compared to the wicking element 80 described above.

Referring to FIG. 20, a plurality of vents in the form of slots 128 are defined in the film 120 towards its proximal longitudinal edge 121. The slots 128 are positioned for receiving any ink, which does not enter the channel inlet 125. For example, any ink deposited on the outer surface of the film 120 (i.e. the upper surface of the film 120 as shown in FIG. 19) during printhead maintenance, is wicked into the channel 124 via the slots 128. The elongate slots 128, extending longitudinally along the film 120, have been shown to be particularly effective in wicking ink into the channel 124. However, any shape of vent may equally be used for the same purpose.

Figure 21:
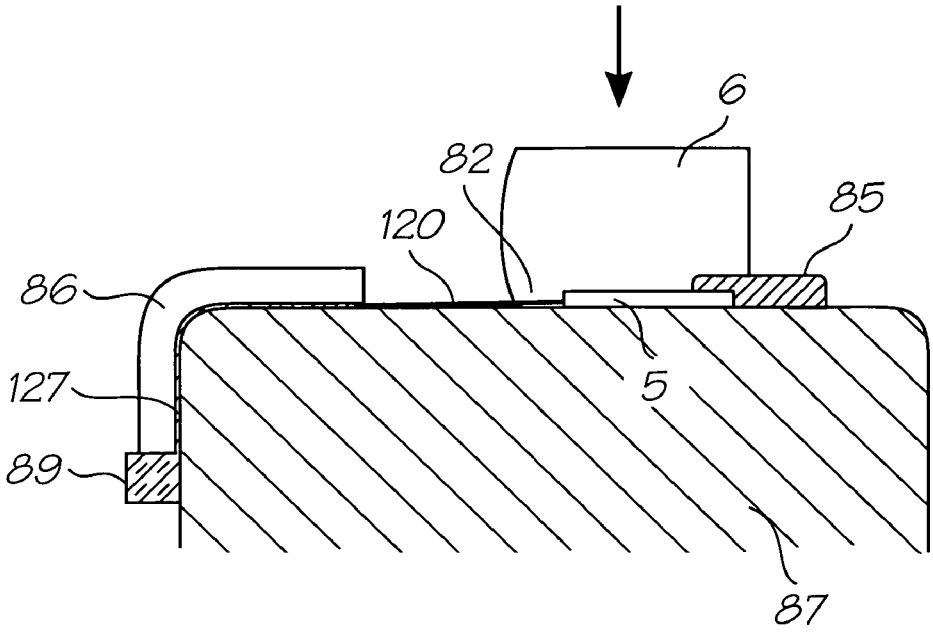
FIG. 21 is a schematic side view of the printhead assembly shown in FIG. 19 with the pad fully engaged.
Figure 22:
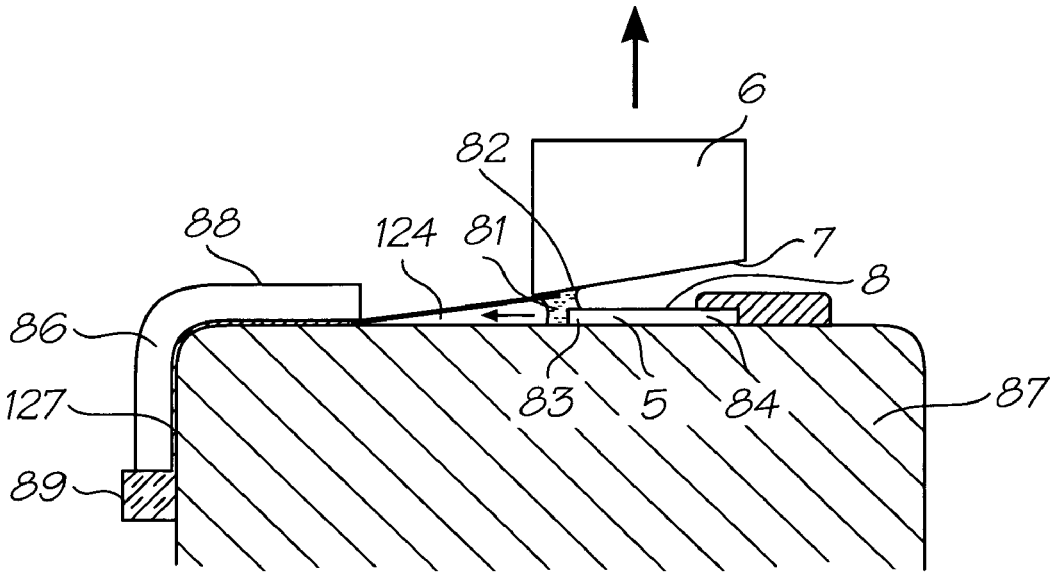
FIG. 22 is a schematic side view of the printhead assembly shown in FIG. 21 at the point of disengagement.

Referring to FIGS. 21 and 22, there is shown a printhead maintenance operation including cooperation of the contact surface 7 and the film 120. In FIG. 21, the pad 6 is fully engaged with the printhead 5. The edge portion 82 of the contact surface 7 abuts against the film 120, urging the film against the support 87. The edge portion 82 contacts the film 120 so that the vents 128 are sealed by the contact surface 7. In this way, any ink on the edge portion 82 of the contact surface 7 is squeezed into the vents 128 and into the channel 124, during engagement of the pad 6.

In FIG. 22, the contact surface 7 has peeled away from the ink ejection face 8 so that ink 81 has moved towards the edge portions 82 and 83. Due to the resilience of the film 120 (and due, in part, to stiction forces between the film 120 and the contact surface 7), the tapered channel 124 is defined as the pad 6 is disengaged from the printhead 5. Accordingly, as shown in FIG. 22, the ink 81 removed from the ink ejection face 8 is positioned in the channel inlet 125 at the point of disengagement.

Once the ink 81 has entered the channel inlet 125, it is rapidly wicked towards the channel outlet 126 due to the tapering of the channel 124 and the capillary action provided thereby. The ink 81 is subsequently received by the secondary wicking element 127 and deposited into the ink collector 89. Hence, efficient and rapid removal of ink 81 away from the contact surface 7 and/or printhead 5 is achieved.

Engagement Mechanism with Rotating Pad-Cleaning Action

As described above, a wicking element 80 or film 120 may be positioned adjacent an edge portion 83 of the printhead 5, so that ink 81 is removed from the contact surface 7, ready for the next cleaning sequence.

In an alternative embodiment, the maintenance station may be configured so that ink is removed from contact surface 7 after the pad 6 is disengaged from the printhead face 8. In this embodiment, the engagement mechanism is configured to move the contact surface 7 into engagement with a remote cleaning means after it has disengaged from the printhead face 8. For example, rotation of the pad 6 after disengagement may be used to bring the contact surface 7 into cleaning engagement with a squeegee or blotter. Rotation may, for example, rock the pad through an arc and past a squeegee. Alternatively, rotation may be fully through 180° using a similar mechanism to those used in rotating 'self-inking' stamps. Self-inking stamps have been known for decades in the stamping art (see, for example, U.S. Pat. Nos. 239,779; 405,704; 669,137; 827,347; 1,121,940; 2,079,080; 2,312,727; 2,919,645; 3,364,856; 3,402,663; 3,631,799; 3,952,653; 3,988,987; 4,432,281 and 4,852,489, the contents of which are incorporated herein by cross-reference), and the skilled person will readily appreciate how such stamping mechanisms may be used to rotate the pad 6 through 180° onto a blotter after it has disengaged from the printhead face 8.

FIGS. 23A-D show a cleaning sequence for a printhead assembly 90, in which the pad 6 is cleaned after disengagement from the printhead face 8 by rocking past a rubber squeegee.

Figure 23A:
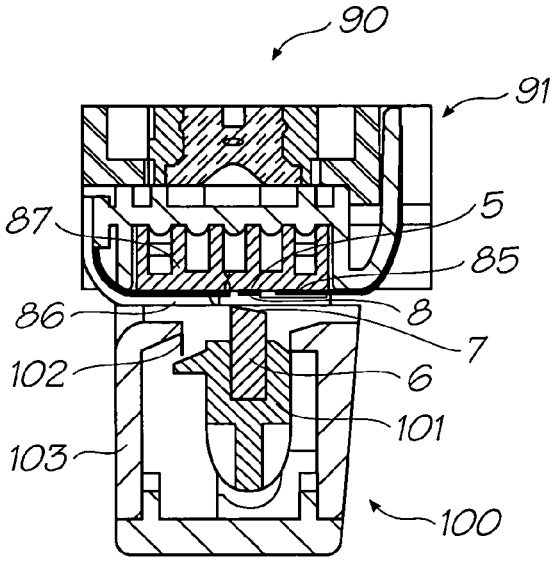
FIGS. 23A-D are transverse side section views of a printhead maintenance station, having a rotating pad cleaning action, in various stages of a printhead maintenance cycle.

Referring to FIG. 23A, there is shown in cross-section a printhead cartridge 91 comprising the printhead 5 mounted on support 92. Encapsulated wirebonds 85 extend from one longitudinal edge of the printhead 5, while the paper guide 88 is fixed to the support 87 on an opposite side of the printhead. Still referring to FIG. 23A, there is also shown a printhead maintenance station 100 comprising the pad 6 having the contact surface 7 for engagement with the ink ejection face 8 of the printhead 5. The pad is mounted on a cradle 101, which can be moved vertically towards the printhead 5 and which can also be rotated or rocked towards a rubber squeegee 102 fixed to a wall 103 of the maintenance station 100.

Figure 23B:
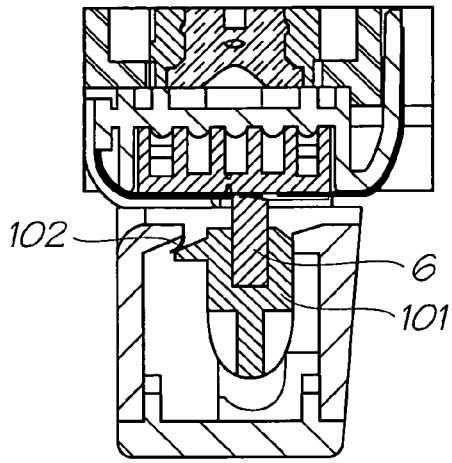

Referring now to FIG. 23B, the sloped contact surface 7 is brought into sealing engagement with the printhead face 8 by moving the pad 6 vertically upwards using an engagement mechanism (not shown) similar to that shown in FIGS. 7-11.

Figure 23C:
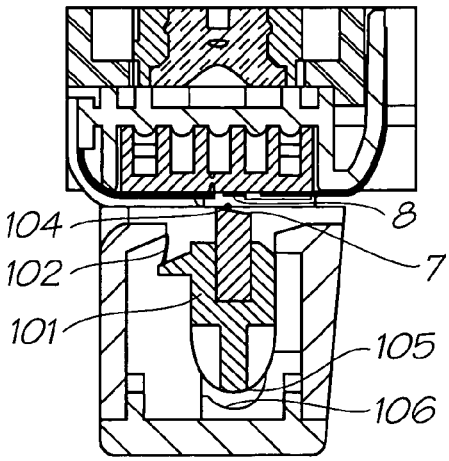

In FIG. 23C, the printhead face 8 is cleaned by moving the pad 6 vertically downwards, thereby peeling the contact surface 7 away from the printhead face. A droplet of ink 104 is deposited along an edge portion of the contact surface 7 after it has disengaged from the printhead.

Figure 23D:
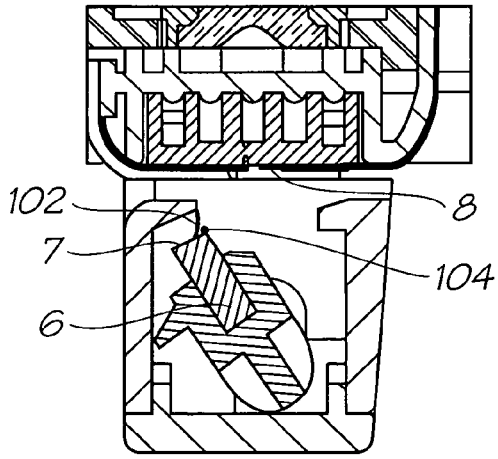

In FIG. 23D, the engagement mechanism (not shown) moves the cradle 101 further downwards so that its bottom surface 105 abuts with a cam surface 106 on the maintenance station. Abutment of the cradle 101 with the cam surface 106 causes the cradle to rock towards the rubber squeegee 102. The squeegee 102 removes the ink droplet 104 from the contact surface 7 as it rocks past the squeegee. This cleans the pad ready for re-use in the next maintenance cycle. Any suitable cleaning means, such as a foam pad, may of course be used to clean the pad 6 instead of the rubber squeegee 102 shown in FIGS. 19A-D.

Finally, the cradle 101 is moved back into the position shown in FIG. 23A, which completes the maintenance cycle. A biasing mechanism (not shown) rocks the cradle 101 back into its vertical position shown in FIG. 23A as the cradle is moved upwards and away from the cam surface 106.

It will, of course, be appreciated that the present invention has been described purely by way of example and that modifications of detail may be made within the scope of the invention, which is defined by the accompanying claims.

The invention claimed is:

1. A printhead maintenance station for maintaining a printhead in an operable condition, said maintenance station comprising:

an elastically deformable pad having a contact surface for sealing engagement with an ink ejection face of said printhead; and an engagement mechanism for moving said pad between a first position in which said contact surface is sealingly engaged with said face, a second position in which said contact surface is disengaged from said face, and a third position in which said contact surface is engaged with a pad cleaner, wherein said engagement mechanism rotates said pad between said second and third positions.

2. The printhead maintenance station of claim 1, wherein said maintenance station is configured such that said contact surface is progressively contacted with said face during sealing engagement and peeled away from said face during disengagement.

3. The maintenance station of claim 2, wherein said peeling disengagement draws ink from said printhead towards an edge portion of said contact surface and/or said face.

4. The maintenance station of claim 1, wherein said pad is substantially coextensive with said printhead.

5. The maintenance station of claim 1, wherein said contact surface is substantially uniform.

6. The maintenance station of claim 1, wherein said pad is comprised of silicone or polyurethane.

7. The maintenance station of claim 1, wherein a peel zone between said contact surface and said ink ejection face advances and retreats transversely across said face during engagement and disengagement.

8. The maintenance station of claim 1, wherein said engagement mechanism moves said pad linearly between said first and second positions, said linear movement being substantially perpendicular to said ink ejection face.

9. The maintenance station of claim 1, wherein said contact surface is sloped with respect to said ink ejection face such that, during engagement, a first part of said surface is contacted with said face prior to a second part of said surface.

10. The maintenance station of claim 1, wherein said pad is biased towards said first position relative to said second position.

11. The maintenance station of claim 1, wherein said engagement mechanism comprises a cam surface for abutment with a cradle on which said pad is mounted, said abutment causing rotation of said cradle from said second position to said third position.

12. The maintenance station of claim 1, wherein said pad is biased towards said second position relative to said third position.

13. The maintenance station of claim 1, wherein said pad cleaner is positioned remotely from said printhead.

14. The maintenance station of claim 1, wherein said maintenance station further comprises said pad cleaner.

15. The maintenance station of claim 1, wherein said pad cleaner is positioned for removing ink deposited on said contact surface from said printhead.

16. The maintenance station of claim 1, wherein said pad cleaner comprises a squeegee or an absorbent pad.

17. The maintenance station of claim 1, wherein said printhead is an inkjet printhead.

18. The maintenance station of claim 1, wherein said printhead is a pagewidth printhead.

* * * * *